US009599954B2

(12) United States Patent
Mushika

(10) Patent No.: US 9,599,954 B2
(45) Date of Patent: Mar. 21, 2017

(54) CARTRIDGE

(71) Applicant: Brother Kogyo Kabushiki Kaisha, Nagoya-shi, Aichi-ken (JP)

(72) Inventor: Motoaki Mushika, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/670,676

(22) Filed: Mar. 27, 2015

(65) Prior Publication Data

US 2015/0277356 A1 Oct. 1, 2015

(30) Foreign Application Priority Data

Mar. 31, 2014 (JP) ..... 2014-074731

(51) Int. Cl.
*G03G 15/08* (2006.01)
*G03G 21/16* (2006.01)
*G03G 21/18* (2006.01)

(52) U.S. Cl.
CPC ..... *G03G 21/1647* (2013.01); *G03G 15/0865* (2013.01); *G03G 21/1896* (2013.01); *G03G 2221/1657* (2013.01)

(58) Field of Classification Search
CPC ..... G03G 21/1647; G03G 21/1857; G03G 21/1896
See application file for complete search history.

(56) References Cited

U.S. PATENT DOCUMENTS 4,974,020 A 11/1990 Takamatsu et al.
5,053,816 A 10/1991 Takahashi
5,489,976 A 2/1996 Ichikawa
5,495,323 A 2/1996 Meetze, Jr.
5,495,327 A 2/1996 Inomata
5,640,651 A 6/1997 Katoh et al.
5,649,264 A 7/1997 Domon et al.
5,970,293 A 10/1999 Huang
6,088,561 A 7/2000 Kawamura et al.
6,154,619 A 11/2000 Boockholdt et al.
6,714,224 B2 3/2004 Yamanaka et al.
6,792,217 B2 9/2004 Nishino et al.
(Continued)

FOREIGN PATENT DOCUMENTS

AU 2010281279 B2 2/2014
CN 1445624 A 10/2003
(Continued)

OTHER PUBLICATIONS

Apr. 14, 2014 (US) Non-Final Office Action in U.S. Appl. No. 13/628,492.

(Continued)

*Primary Examiner* — Erika J Villaluna
(74) *Attorney, Agent, or Firm* — Banner & Witcoff, Ltd.

(57) ABSTRACT

A cartridge including a housing configured to accommodate therein developer, a driving receiving part configured to rotate by receiving a driving force, and a detected member configured to move in an axis direction parallel with a rotational axis of the driving receiving part by receiving a driving force from the driving receiving part, wherein the detected member is configured to perform a reciprocating movement, in which the detected member moves outward in the axis direction to be separated from the housing and then moves inward in the axis direction to come close to the housing, for a plurality of times.

31 Claims, 22 Drawing Sheets

(56) References Cited

U.S. PATENT DOCUMENTS

| | | | |
|---|---|---|---|
| 6,823,160 | B2 | 11/2004 | Okabe |
| 6,829,465 | B2 | 12/2004 | Yamanaka et al. |
| 6,903,759 | B2 | 6/2005 | Yamanaka et al. |
| 6,909,866 | B2 | 6/2005 | Kawai |
| 6,920,303 | B2 | 7/2005 | Yamanaka et al. |
| 7,116,919 | B2 | 10/2006 | Ishii |
| 7,130,551 | B2 | 10/2006 | Kobayashi |
| 7,418,214 | B2 | 8/2008 | Yoshida et al. |
| 7,463,834 | B2 | 12/2008 | Takagi et al. |
| 7,509,075 | B2 | 3/2009 | Hayakawa |
| 7,512,347 | B2 | 3/2009 | Suzuki et al. |
| 7,536,117 | B2 | 5/2009 | Kishi |
| 7,613,414 | B2 | 11/2009 | Kamimura |
| 7,643,777 | B2 | 1/2010 | Matsumoto et al. |
| 7,756,426 | B2 | 7/2010 | Kamimura |
| 7,933,536 | B2 | 4/2011 | Ogawa |
| 7,953,330 | B2 | 5/2011 | Ishikawa |
| 8,010,026 | B2 | 8/2011 | Kobayashi et al. |
| RE42,796 | E | 10/2011 | Ishii |
| 8,090,272 | B2 | 1/2012 | Ishikawa |
| 8,099,025 | B2 | 1/2012 | Ishikake |
| 8,126,366 | B2 | 2/2012 | Hattori |
| 8,417,130 | B2 | 4/2013 | Hashimoto |
| 8,463,145 | B2 | 6/2013 | Ukai et al. |
| 8,583,009 | B2 | 11/2013 | Takagi |
| 8,600,244 | B2 | 12/2013 | Hashimoto |
| 8,620,180 | B2 | 12/2013 | Shiraki et al. |
| 8,666,293 | B2 | 3/2014 | Mushika et al. |
| 8,744,288 | B2 | 6/2014 | Shinoya et al. |
| 8,761,643 | B2 | 6/2014 | Mushika et al. |
| 8,849,133 | B2 | 9/2014 | Itabashi et al. |
| 8,867,932 | B2 | 10/2014 | Ukai et al. |
| 8,948,617 | B2 | 2/2015 | Shiraki et al. |
| 8,948,661 | B2 | 2/2015 | Mushika et al. |
| 9,195,207 | B2 | 11/2015 | Itabashi |
| 9,207,567 | B2 | 12/2015 | Mushika et al. |
| 2003/0185579 | A1 | 10/2003 | Nishino et al. |
| 2003/0185594 | A1 | 10/2003 | Okabe |
| 2003/0215265 | A1 | 11/2003 | Kawai |
| 2006/0034625 | A1 | 2/2006 | Kajikawa |
| 2006/0104670 | A1 | 5/2006 | Nishitani et al. |
| 2006/0165423 | A1 | 7/2006 | Nishitani et al. |
| 2006/0171737 | A1 | 8/2006 | Nishimura et al. |
| 2006/0193643 | A1 | 8/2006 | Takagi et al. |
| 2006/0193646 | A1 | 8/2006 | Suzuki et al. |
| 2006/0245787 | A1 | 11/2006 | Ito et al. |
| 2007/0031158 | A1 | 2/2007 | Kamimura |
| 2007/0041747 | A1 | 2/2007 | Kim et al. |
| 2007/0059018 | A1 | 3/2007 | Tokuda |
| 2007/0059038 | A1 | 3/2007 | Shiraki |
| 2007/0077101 | A1 | 4/2007 | Tamura et al. |
| 2007/0122165 | A1 | 5/2007 | Igarashi et al. |
| 2007/0140709 | A1 | 6/2007 | Yoshida et al. |
| 2007/0140725 | A1 | 6/2007 | Kamimura |
| 2007/0253748 | A1 | 11/2007 | Matsumoto et al. |
| 2008/0080904 | A1 | 4/2008 | Murayama et al. |
| 2008/0205911 | A1 | 8/2008 | Ishikawa et al. |
| 2008/0205928 | A1 | 8/2008 | Ishikawa |
| 2008/0205931 | A1 | 8/2008 | Ishikawa |
| 2008/0223173 | A1 | 9/2008 | Ishikawa |
| 2008/0317509 | A1 | 12/2008 | Mori |
| 2009/0000423 | A1 | 1/2009 | Ishikawa et al. |
| 2009/0052911 | A1 | 2/2009 | Richey et al. |
| 2009/0084210 | A1 | 4/2009 | Tsukada et al. |
| 2009/0169247 | A1 | 7/2009 | Hattori |
| 2009/0257782 | A1 | 10/2009 | Ishikake |
| 2009/0269085 | A1 | 10/2009 | Ukai |
| 2009/0269086 | A1 | 10/2009 | Mikuni |
| 2009/0285604 | A1 | 11/2009 | Nakajima |
| 2009/0297226 | A1 | 12/2009 | Nagashima et al. |
| 2010/0054763 | A1 | 3/2010 | Tomiyori et al. |
| 2010/0209144 | A1 | 8/2010 | Nieda |
| 2011/0023368 | A1 | 2/2011 | Mizutani et al. |
| 2011/0038649 | A1 | 2/2011 | Miyabe et al. |
| 2011/0081163 | A1 | 4/2011 | Lee |
| 2011/0123231 | A1 | 5/2011 | Ozawa et al. |
| 2011/0236062 | A1 | 9/2011 | Takagi |
| 2011/0236065 | A1 | 9/2011 | Takagi |
| 2011/0236066 | A1 | 9/2011 | Takagi |
| 2011/0243578 | A1 | 10/2011 | Ukai et al. |
| 2012/0014713 | A1 | 1/2012 | Murakami et al. |
| 2012/0051795 | A1 | 3/2012 | Mushika et al. |
| 2012/0057905 | A1 | 3/2012 | Itabashi |
| 2012/0134688 | A1 | 5/2012 | Hashimoto |
| 2012/0148297 | A1 | 6/2012 | Peng et al. |
| 2012/0177398 | A1 | 7/2012 | Takigawa |
| 2012/0243882 | A1 | 9/2012 | Carot |
| 2012/0251165 | A1 | 10/2012 | Mushika et al. |
| 2012/0251216 | A1 | 10/2012 | Mushika |
| 2012/0321345 | A1 | 12/2012 | Shinoya et al. |
| 2013/0051813 | A1 | 2/2013 | Itabashi et al. |
| 2013/0051814 | A1 | 2/2013 | Itabashi et al. |
| 2013/0051815 | A1 | 2/2013 | Itabashi et al. |
| 2013/0051816 | A1 | 2/2013 | Itabashi |
| 2013/0051833 | A1 | 2/2013 | Itabashi et al. |
| 2013/0084083 | A1 | 4/2013 | Itabashi et al. |
| 2013/0136460 | A1 | 5/2013 | Shiraki et al. |
| 2013/0170844 | A1 | 7/2013 | Itabashi |
| 2013/0170845 | A1 | 7/2013 | Itabashi |
| 2013/0259528 | A1 | 10/2013 | Yamamoto |
| 2013/0272724 | A1 | 10/2013 | Ukai et al. |
| 2014/0020489 | A1 | 1/2014 | Nozaki et al. |
| 2014/0086638 | A1 | 3/2014 | Sato |
| 2014/0169835 | A1 | 6/2014 | Nakajima |
| 2014/0219690 | A1 | 8/2014 | Li et al. |
| 2014/0294403 | A1 | 10/2014 | Shimizu |
| 2014/0341617 | A1 | 11/2014 | Mushika et al. |
| 2014/0363189 | A1 | 12/2014 | Hashimoto et al. |
| 2014/0376968 | A1 | 12/2014 | Yamamoto et al. |
| 2015/0000443 | A1 | 1/2015 | Shimizu |
| 2015/0003844 | A1 | 1/2015 | Ukai et al. |
| 2015/0005134 | A1 | 1/2015 | Shimizu |
| 2015/0010334 | A1 | 1/2015 | Nakajima |
| 2015/0037071 | A1 | 2/2015 | Yamamoto |
| 2015/0043944 | A1 | 2/2015 | Yamamoto |
| 2015/0104222 | A1 | 4/2015 | Mushika et al. |
| 2015/0117873 | A1 | 4/2015 | Mori et al. |
| 2015/0117906 | A1 | 4/2015 | Mori |
| 2015/0153675 | A1 | 6/2015 | Itabashi et al. |

FOREIGN PATENT DOCUMENTS

| | | | |
|---|---|---|---|
| CN | 1828447 | A | 9/2006 |
| CN | 1288515 | C | 12/2006 |
| CN | 2884266 | Y | 3/2007 |
| CN | 1983078 | A | 6/2007 |
| CN | 101063855 | A | 10/2007 |
| CN | 200962188 | Y | 10/2007 |
| CN | 101256379 | A | 9/2008 |
| CN | 101295157 | A | 10/2008 |
| CN | 201170840 | Y | 12/2008 |
| CN | 100476636 | C | 4/2009 |
| CN | 201222170 | Y | 4/2009 |
| CN | 101625537 | B | 1/2010 |
| CN | 201402371 | Y | 2/2010 |
| CN | 201464807 | U | 5/2010 |
| CN | 201489284 | U | 5/2010 |
| CN | 202102251 | U | 1/2012 |
| CN | 202472249 | U | 10/2012 |
| CN | 102799090 | A | 11/2012 |
| CN | 202649679 | U | 1/2013 |
| CN | 203673223 | U | 6/2014 |
| EP | 0838733 | A2 | 4/1998 |
| EP | 1696278 | A2 | 8/2006 |
| EP | 1696278 | A3 | 8/2006 |
| EP | 1965268 | A1 | 9/2008 |
| EP | 1965274 | A2 | 9/2008 |
| EP | 1995644 | A2 | 11/2008 |
| EP | 2093619 | A1 | 8/2009 |
| EP | 2369422 | A1 | 9/2011 |
| EP | 2378378 | A2 | 10/2011 |
| EP | 2463723 | A1 | 6/2012 |
| EP | 2463723 | A4 | 6/2012 |
| EP | 2574991 | A2 | 4/2013 |

(56) References Cited

FOREIGN PATENT DOCUMENTS

| | | | |
|---|---|---|---|
| EP | 2574992 | A2 | 4/2013 |
| EP | 2574993 | A2 | 4/2013 |
| HK | 1090991 | A1 | 11/2009 |
| JP | S5323696 | | 2/1978 |
| JP | S6183570 | A | 4/1986 |
| JP | S63-118042 | U | 7/1988 |
| JP | H01205175 | A | 8/1989 |
| JP | H02-78949 | U | 6/1990 |
| JP | H02-262168 | A | 10/1990 |
| JP | H03-212656 | A | 9/1991 |
| JP | H04-31156 | A | 2/1992 |
| JP | H04-31156 | U | 3/1992 |
| JP | H04-191773 | A | 7/1992 |
| JP | H04-112263 | U | 9/1992 |
| JP | H04-114057 | U | 10/1992 |
| JP | 5323696 | B2 | 12/1993 |
| JP | 06-208301 | A | 7/1994 |
| JP | H07-140776 | A | 6/1995 |
| JP | H07-281519 | | 10/1995 |
| JP | H08-179608 | A | 7/1996 |
| JP | H08-248838 | A | 9/1996 |
| JP | H09160466 | A | 6/1997 |
| JP | H09222783 | A | 8/1997 |
| JP | 2551714 | Y2 | 10/1997 |
| JP | H09-258634 | A | 10/1997 |
| JP | H10-301382 | A | 11/1998 |
| JP | H11-37169 | A | 2/1999 |
| JP | H11-52716 | A | 2/1999 |
| JP | 2000338760 | A | 12/2000 |
| JP | 2001-042585 | A | 2/2001 |
| JP | 2001-166648 | A | 6/2001 |
| JP | 3266779 | B2 | 3/2002 |
| JP | 2002-169449 | A | 6/2002 |
| JP | 2003-271039 | A | 9/2003 |
| JP | 2003295614 | A | 10/2003 |
| JP | 2003-337504 | A | 11/2003 |
| JP | 2004-045603 | B2 | 2/2004 |
| JP | 2005-241942 | A | 9/2005 |
| JP | 3710375 | B2 | 10/2005 |
| JP | 2006-235236 | A | 9/2006 |
| JP | 2006-243072 | A | 9/2006 |
| JP | 2006-267994 | A | 10/2006 |
| JP | 2007-079284 | A | 3/2007 |
| JP | 2007-164095 | A | 6/2007 |
| JP | 2007-199514 | A | 8/2007 |
| JP | 2008-089731 | A | 4/2008 |
| JP | 2008-216391 | A | 9/2008 |
| JP | 2008-216392 | A | 9/2008 |
| JP | 2008-216393 | A | 9/2008 |
| JP | 2008-216394 | A | 9/2008 |
| JP | 2008216919 | A | 9/2008 |
| JP | 2008299123 | A | 12/2008 |
| JP | 2008299124 | A | 12/2008 |
| JP | 2008299125 | A | 12/2008 |
| JP | 2009069177 | A | 4/2009 |
| JP | 2009-162915 | A | 7/2009 |
| JP | 2009-180983 | A | 8/2009 |
| JP | 4310703 | B2 | 8/2009 |
| JP | 2009-223017 | A | 10/2009 |
| JP | 2009-244560 | A | 10/2009 |
| JP | 2009244563 | A | 10/2009 |
| JP | 2009-276727 | A | 11/2009 |
| JP | 4372703 | B2 | 11/2009 |
| JP | 2009-282099 | A | 12/2009 |
| JP | 2009-288549 | A | 12/2009 |
| JP | 4376861 | B2 | 12/2009 |
| JP | 2011-013323 | A | 1/2011 |
| JP | 3167011 | U | 3/2011 |
| JP | 2011-215374 | A | 10/2011 |
| JP | 4859139 | B2 | 1/2012 |
| JP | 2012-053095 | A | 3/2012 |
| JP | 2012-108537 | A | 6/2012 |
| JP | 2012-194318 | A | 10/2012 |
| JP | 2012-212086 | A | 11/2012 |
| JP | 2012-233941 | A | 11/2012 |
| JP | 2013-011911 | A | 1/2013 |
| JP | 2013501253 | A | 1/2013 |
| JP | 2013054063 | A | 3/2013 |
| RU | 2011138921 | A | 9/2013 |
| WO | 2007062588 | A1 | 6/2007 |
| WO | 2011/015051 | A1 | 2/2011 |
| WO | 2013040989 | A1 | 3/2013 |
| WO | 2013073134 | A1 | 5/2013 |

OTHER PUBLICATIONS

Sep. 23, 2014—(US) Notice of Allowance—U.S. Appl. No. 13/628,492.
Apr. 15, 2015—(US) Notice of Allowance—U.S. Appl. No. 14/529,221.
Aug. 4, 2015—(US) Notice of Allowance—U.S. Appl. No. 14/577,396.
Aug. 25, 2015—(US) Non-Final Office Action—U.S. Appl. No. 14/671,413.
Jul. 22, 2015—(US) Non-Final Office Action—U.S. Appl. No. 14/316,971.
May 18, 2015—(US) Non-Final Office Action—U.S. Appl. No. 14/611,393.
Oct. 5, 2015—(US) Non-Final Office Action—U.S. Appl. No. 14/670,801.
Sep. 17, 2015—(EP) Office Action—App 11179283.4.
Sep. 17, 2015—(US) Non-Final Office Action—U.S. Appl. No. 14/670,489.
Sep. 23, 2015—(US) Notice of Allowance—U.S. Appl. No. 14/529,221.
Sep. 30, 2015—(US) Non-Final Office Action—U.S. Appl. No. 14/670,522.
Sep. 16, 2015—(US) Notice of Allowance—U.S. Appl. No. 14/485,462.
Aug. 21, 2015 (EP) Extended EP Search Report—App. No. 15161258.7.
Aug. 20, 2015—(EP) Extended EP Search Report in App No. 15161221.5.
Feb. 27, 2014—(KR) Notice of Preliminary Rejection—App 10-2012-7028457.
Machine translation of JP 2006-235236 dated Jan. 9, 2014.
Jan. 5, 2012—(JP) Decision of Patent Grant—App 2010-083408.
Apr. 26, 2011—(WO) International Search Report (JPO)—App PCT/JP2011/057946.
Nov. 12, 2014—(US) Non-Final Office Action—U.S. Appl. No. 14/485,462.
Dec. 31, 2014—(CN) Notification of First Office Action—App 201310175410.5, Eng Tran.
Mar. 20, 2015—(US) Final Office Action—U.S. Appl. No. 14/485,462.
Decision to Grant a Patent issued in corresponding Japanese Patent Application No. 2010-193204 dated Sep. 18, 2012.
Notice of Reasons for Rejection issued in Japanese Patent Application No. 2012-229560 mailed Feb. 19, 2013.
Machine translation of JP 07-281519A dated May 2, 2013.
Machine translation of JP 10-031382A dated May 1, 2013.
Notice of Allowance received in U.S. Appl. No. 13/222,096 mailed Oct. 16, 2013.
Office Action received in related Chinese Patent Application No. 201110251898.6 mailed Oct. 15, 2013.
Notification of the First Office Action with Search Report issued in corresponding Chinese Patent Application No. 201110251898.6 dated Dec. 11, 2012.
Notice of Reasons for Rejection issued in corresponding Japanese Patent Application 2010-193204 mailed Jun. 26, 2012.
Notice of Allowance issued in corresponding U.S. Appl. No. 14/154,521 mailed Feb. 10, 2014.
Sep. 19, 2014—(US) Notice of Allowance—U.S. Appl. No. 14/275,251.
Mar. 19, 2015—(US) Non-Final Office Action—U.S. Appl. No. 14/577,396.
Co-pending U.S. Appl. No. 14/316,959, filed Jun. 27, 2014.
Co-Pending U.S. Appl. No. 14/316,971, filed Jun. 27, 2014.

(56) References Cited

OTHER PUBLICATIONS

Apr. 6, 2015—(US) Non-Final Office Action—U.S. Appl. No. 14/316,959.
Apr. 21, 2015—(EP) Extended Search Report—App 14173865.8.
May 8, 2015—Ex Parte Quayle—U.S. Appl. No. 14/316,971.
May 8, 2015—(US) Ex Parte Quayle—U.S. Appl. No. 14/316,971.
Mar. 3, 2015—(CN) Notification of First Office Action—App 201310175264.6, Eng Tran.
Mar. 3, 2015—(CN) Notification of First Office Action—App 201310175229.4, Eng Tran.
Mar. 27, 2015—(US) Co-pending U.S. Appl. No. 14/670,502.
Sep. 17, 2015—(EP) Office Action—App 11160291.8.
Oct. 19, 2015—(US) Non-Final Office Action—U.S. Appl. No. 14/611,393.
Oct. 28, 2015—(US) Notice of Allowance—U.S. Appl. No. 14/316,959.
Nov. 27, 2015—(US) Non-Final Office Action—U.S. Appl. No. 14/670,502.
Dec. 14, 2015—(US) Non-Final Office Action—U.S. Appl. No. 14/926,345.
Jan. 20, 2016—(US) Notice of Allowance—U.S. Appl. No. 14/316,971.
Jan. 21, 2016—(US) Notice of Allowance—U.S. Appl. No. 14/485,462.
Aug. 19, 2015—(US) Non-Final Office Action—U.S. Appl. No. 14/589,696.
Sep. 16, 2013—(US) Non-final office action—U.S. Appl. No. 13/431,077.
Sep. 6, 2013—(CN) Office Action—App 201210083604.8.
Mar. 27, 2014—(US) Notice of Allowance—U.S. Appl. No. 13/431,077.
May 1, 2015—(US) Non-Final Office Action—U.S. Appl. No. 14/491,157.
Dec. 24, 2015—(US) Notice of Allowance—U.S. Appl. No. 14/491,157.
Sep. 30, 2013—(CN) Office Action—App 201210083716.3.
Nov. 19, 2013—(JP) Office Action—App 2013-103770.
Jan. 8, 2014—(US) Notice of Allowance—U.S. Appl. No. 13/430,950.
May 27, 2014—(EP) Extended Search Report—App 12161226.1.
Feb. 4, 2015—(US) Notice of Allowance—U.S. Appl. No. 14/289,780.
Jan. 20, 2015—(JP) Notification of Reasons for Refusal—App 2014-042421, Eng Tran.
Jul. 16, 2012—(EP ) Search Report—App 12157690.4.
Feb. 19, 2014—(US) Notice of Allowance—U.S. Appl. No. 13/431,074.
Jun. 19, 2014—(US) Non-final office action—U.S. Appl. No. 14/290,188.
Oct. 7, 2014—(US) Notice of Allowance—U.S. Appl. No. 14/290,188.
Feb. 25, 2016—(US) Non-Final Office Action—U.S. Appl. No. 14/316,959.
Apr. 26, 2016—(US) Non-Final Office Action—U.S. Appl. No. 15/079,829.
May 9, 2016—(US) Notice of Allowance—U.S. Appl. No. 14/670,489.
May 24, 2016—(US) Notice of Allowance—U.S. Appl. No. 14/485,462.
Feb. 8, 2016—(EP) Extended European Search Report—App 15161221.5.
Sep. 23, 2015—(EP) Extended European Search Report—App 15161223.1.
Sep. 23, 2015—(EP) Extended European Search Report—App 15161224.9.
Sep. 25, 2015—(EP) Extended European Search Report—App 15161229.8.
Sep. 29, 2015—(EP) Extended European Search Report—App 15161242.1.
Feb. 17, 2016—(US) Notice of Allowance—U.S. Appl. No. 14/671,413.
Mar. 4, 2016—(US) Notice of Allowance—U.S. Appl. No. 14/491,157.
Apr. 1, 2016—(US) Notice of Allowance—U.S. Appl. No. 14/926,345.
Apr. 14, 2016—(US) Notice of Allowance—U.S. Appl. No. 14/670,522.
Jun. 10, 2016—(US) Notice of Allowance—U.S. Appl. No. 141316,971.
Jun. 17, 2016—(US) Notice of Allowance—U.S. Appl. No. 14/491,157.
May 24, 2016—(EP) Communication—App 12157679.7.
May 24, 2016—(EP) Communication—App 12157690.4.
Sep. 11, 2015—(EP) Communication—App 12157690.4.
Jul. 16, 2012—(EP) Search Report 12157679.7.
Jun. 22, 2016—(US) Notice of Allowance—U.S. Appl. No. 14/529,221.
Apr. 16, 2013 (JP) Notice of Allowance—App. 2011100507.
Feb. 17, 2015 (JP) Notice of Allowance—App. 2011078637.
May 11, 2016—(EP) Communication—App 12161226.1.
Feb. 18, 2016—(US) Notice of Allowance—U.S. Appl. No. 14/529,221.
Apr. 12, 2016—(US) Notice of Allowance—U.S. Appl. No. 14/611,393.
Jun. 17, 2016—(US) Notice of Allowance—U.S. Appl. No. 14/926,345.
Sep. 14, 2015—(EP) Communication—App 12157679.7.
Jun. 29, 2016—(US) Notice of Allowance—U.S. Appl. No. 14/611,393.
Jul. 11, 2016—(US) Non-Final Office Action—U.S. Appl. No. 14/670,502.
Sep. 28, 2016—(US) Notice of Allowance—U.S. Appl. No. 14/670,801.
Sep. 12, 2016—(US) Notice of Allowance—U.S. Appl. No. 14/589,696.
Jul. 15, 2016—(US) Notice of Allowance—U.S. Appl. No. 14/670,522.
Aug. 9, 2016—(US) Notice of Allowance—U.S. Appl. No. 15/079,829.
Aug. 1, 2016—(US) Notice of Allowance—U.S. Appl. No. 14/670,516.
Dec. 13, 2016—(JP) Office Action—App 2014000609—Eng Tran.
Dec. 13, 2016—(JP) Office Action—App 2013137425—Eng Tran.
Nov. 22, 2016—(JP) Office Action—App 2013137422—Eng Tran.
Dec. 12, 2016—(JP) Office Action—App 2014074727—Eng Tran.
Dec. 27, 2016—(JP) Office Action—App 2014074728—Eng Tran.
Dec. 27, 2016—(JP) Office Action—App 2014074729—Eng Tran.
Dec. 27, 2016—(JP) Office Action—App 2014074730—Eng Tran.

52B(52)

52B(52)

CARTRIDGE

CROSS-REFERENCE TO RELATED APPLICATIONS

This application claims priority from Japanese Patent Application No. 2014-074731 filed on Mar. 31, 2014, the entire contents of which are incorporated herein by reference.

TECHNICAL FIELD

Aspects of the disclosure relate to a cartridge configured to be mounted to an electrophotographic image forming apparatus.

BACKGROUND

As an electrophotographic printer, a printer to which a cartridge accommodating therein developer can be detachably mounted is known.

In the known printer, when a used cartridge is replaced with an unused cartridge, it is necessary to enable the printer to recognize that the unused cartridge has been mounted.

SUMMARY

It is therefore an object of the disclosure to provide a cartridge capable of enabling an external device to recognize that an unused cartridge has been mounted.

According to an aspect of the disclosure, there is provided a cartridge including: a housing configured to accommodate therein developer; a driving receiving part configured to rotate by receiving a driving force; and a detected member configured to move in an axis direction parallel with a rotational axis of the driving receiving part by receiving a driving force from the driving receiving part, wherein the detected member is configured to perform a reciprocating movement, in which the detected member moves outward in the axis direction to be away from the housing and then moves inward in the axis direction to be closer to the housing, for a plurality of times.

According to another aspect of the disclosure, there is provided a cartridge including: a housing configured to accommodate therein developer; a driving receiving part configured to rotate by receiving a driving force, and a detected member configured to move in an axis direction parallel with a rotational axis of the driving receiving part by receiving a driving force from the driving receiving part, wherein the detected member is configured to perform: a first movement, in which the detected member moves outward in the axis direction to be away from the housing and then moves inward in the axis direction to be closer to the housing; and a second movement, which is performed after the first movement and in which the detected member moves outward in the axis direction to be away from the housing and then moves inward in the axis direction to be closer to the housing.

DETAILED DESCRIPTION

1. Outline of Developing Cartridge

Figure 1:
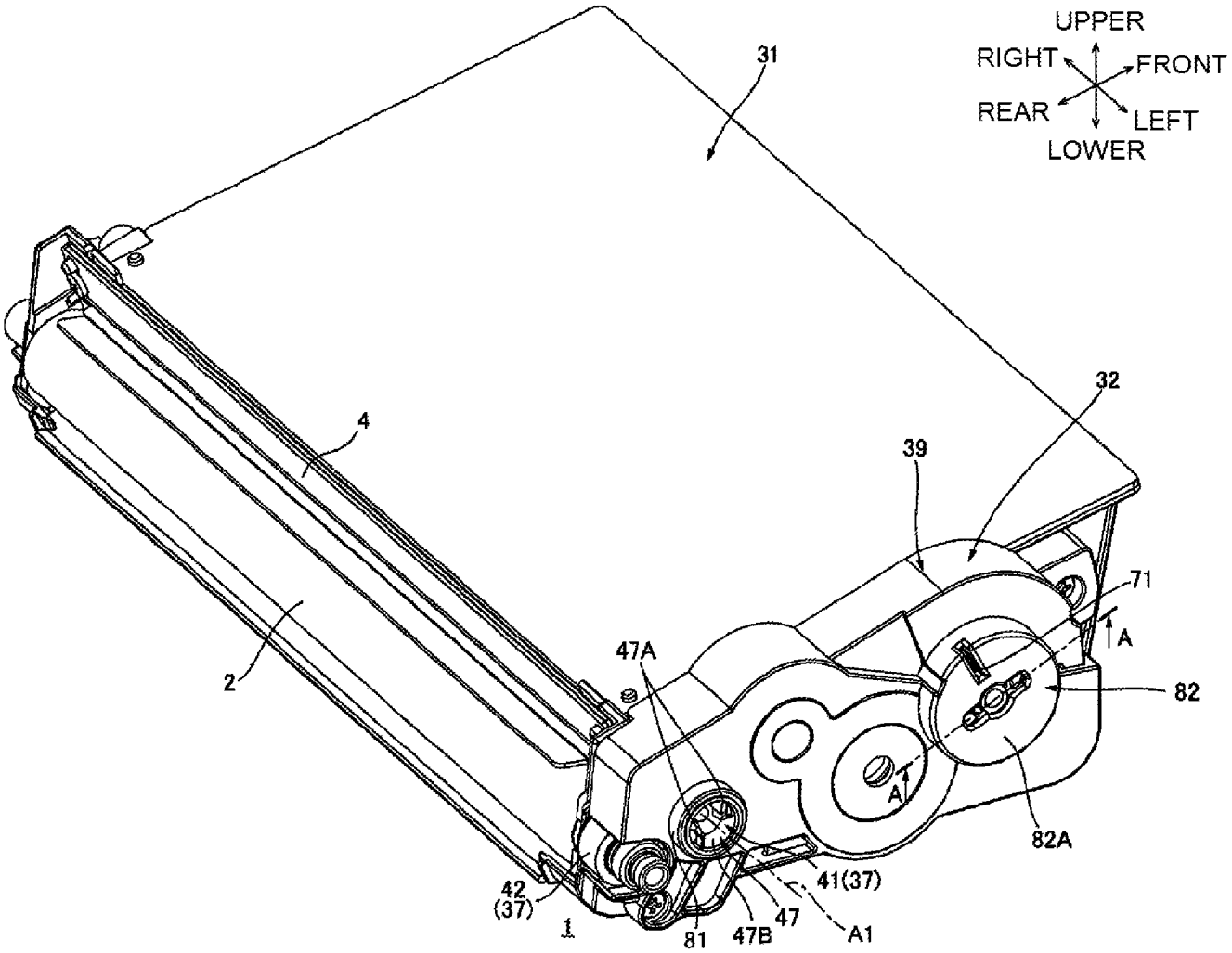
FIG. 1 is a perspective view of a developing cartridge according to a first illustrative embodiment of the cartridge of the disclosure, as seen from a left-rear side.
Figure 2:
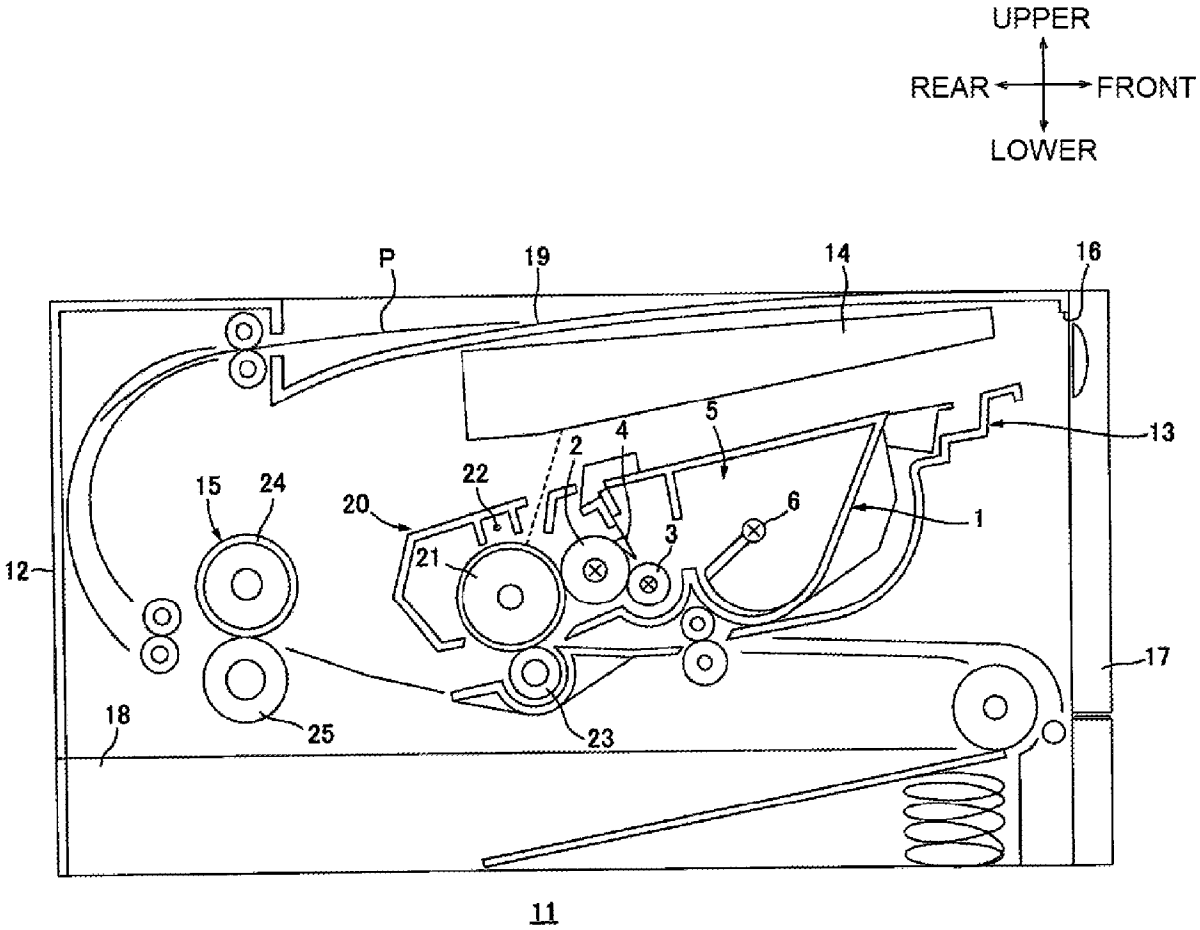
FIG. 2 is a central sectional view of a printer to which the developing cartridge of FIG. 1 is mounted.

As shown in FIGS. 1 and 2, a developing cartridge 1, which is an example of the cartridge, has a developing roller 2, which is an example of the developer carrier, a supply roller 3, a layer thickness regulation blade 4, and a toner accommodating portion 5.

In the description hereinafter, directions of the developing cartridge 1 are described on the basis of a state where the developing cartridge 1 is horizontally placed. Specifically, arrow directions indicated in FIG. 1 are used as the basis. A left-right direction is an example of the axis direction.

The developing roller 2 is rotatably supported by a rear end portion of the developing cartridge 1. The developing roller 2 has a substantially cylindrical shape extending in the left-right direction.

The supply roller 3 is arranged at a front-lower side of the developing roller 2. The supply roller 3 is rotatably supported by the developing cartridge 1. The supply roller 3 has a substantially cylindrical shape extending in the left-right direction. The supply roller 3 contacts a front lower end portion of the developing roller 2.

The layer thickness regulation blade 4 is arranged at a front-upper side of the developing roller 2. The layer thickness regulation blade 4 contacts a front end portion of the developing roller 2.

The toner accommodating portion 5 is arranged in front of the supply roller 3 and the layer thickness regulation blade 4. The toner accommodating portion 5 is configured to accommodate therein toner, which is an example of the developer. The toner accommodating portion 5 has an agitator 6.

The agitator 6 is rotatably supported in the toner accommodating portion 5.

2. Using Aspects of Developing Cartridge

As shown in FIG. 2, the developing cartridge 1 is used while being mounted to an image forming apparatus 11.

The image forming apparatus 11 is an electrophotographic monochrome printer. The image forming apparatus 11 has an apparatus main body 12, a process cartridge 13, a scanner unit 14, and a fixing unit 15.

The apparatus main body 12 has a substantially box shape. The apparatus main body 12 has an opening 16, a front cover 17, a sheet feeding tray 18, and a sheet discharge tray 19.

The opening 16 is arranged at a front end portion of the apparatus main body 12. The opening 16 enables an inside and an outside of the apparatus main body 12 to communicate with each other so that the process cartridge 13 can pass therethrough.

The front cover 17 is arranged at the front end portion of the apparatus main body 12. The front cover 17 has a substantially flat plate shape. The front cover 17 extends in the upper-lower direction, and is swingably supported by a front wall of the apparatus main body 12 at a lower end portion thereof serving as a support point. The front cover 17 is configured to open or close the opening 16.

The sheet feeding tray 18 is arranged at a bottom of the apparatus main body 12. The sheet feeding tray 18 is configured to accommodate therein sheets P.

The sheet discharge tray 19 is arranged at a center of an upper wall of the apparatus main body 12. The sheet discharge tray 19 is recessed downwardly from an upper surface of the apparatus main body 12 so that the sheet P can be placed thereon.

The process cartridge 13 is accommodated at a substantially center of the apparatus main body 12 in the upper-lower direction. The process cartridge 13 is configured to be mounted to the apparatus main body 12 or demounted from the apparatus main body 12. The process cartridge 13 has a drum cartridge 20, and the developing cartridge 1.

The drum cartridge 20 has a photosensitive drum 21, a scorotron-type charger 22, and a transfer roller 23.

The photosensitive drum 21 is rotatably supported by a rear end portion of the drum cartridge 20.

The scorotron-type charger 22 is arranged at an interval from the photosensitive drum 21 at a rear-upper side of the photosensitive drum 21.

The transfer roller 23 is arranged below the photosensitive drum 21. The transfer roller 23 contacts a lower end portion of the photosensitive drum 21.

The developing cartridge 1 is detachably mounted to the drum cartridge 20 so that the developing roller 2 contacts a front end portion of the photosensitive drum 21, in front of the photosensitive drum 21.

The scanner unit 14 is arranged above the process cartridge 13. The scanner unit 14 is configured to emit a laser beam based on image data towards the photosensitive drum 21.

The fixing unit 15 is arranged at the rear of the process cartridge 13. The fixing unit 15 has a heating roller 24, and a pressing roller 25 pressed to a rear lower end portion of the heating roller 24.

When the image forming apparatus 11 starts an image forming operation, the scorotron-type charger 22 uniformly charges a surface of the photosensitive drum 21. The scanner unit 14 exposes the surface of the photosensitive drum 21. Thereby, an electrostatic latent image based on the image data is formed on the surface of the photosensitive drum 21.

Also, the agitator 6 stirs the toner in the toner accommodating portion 5, thereby supplying the same to the supply roller 3. The supply roller 3 supplies the toner supplied by the agitator 6 to the developing roller 2. At this time, the toner is positively friction-charged between the developing roller 2 and the supply roller 3, and is then carried on the developing roller 2. The layer thickness regulation blade 4 regulates a layer thickness of the toner carried on the developing roller 2 to a predetermined thickness.

The toner carried on the developing roller 2 is supplied to the electrostatic latent image on the surface of the photosensitive drum 21. Thereby, a toner image is carried on the surface of the photosensitive drum 21.

The sheet P is fed one by one at predetermined timing from the sheet feeding tray 18 towards between the photosensitive drum 21 and the transfer roller 23 by rotations of a variety of rollers. The toner image on the surface of the photosensitive drum 21 is transferred to the sheet P when the sheet P passes between the photosensitive drum 21 and the transfer roller 23.

Thereafter, the sheet P is heated and pressed while it passes between the heating roller 24 and the pressing roller 25. Thereby, the toner image on the sheet P is heat-fixed on the sheet P. Then, the sheet P is discharged to the sheet discharge tray 19.

3. Details of Developing Cartridge

As shown in FIG. 1, the developing cartridge 1 has a developing frame 31, which is an example of the housing, and a driving unit 32.

(i) Developing Frame

Figure 3B:
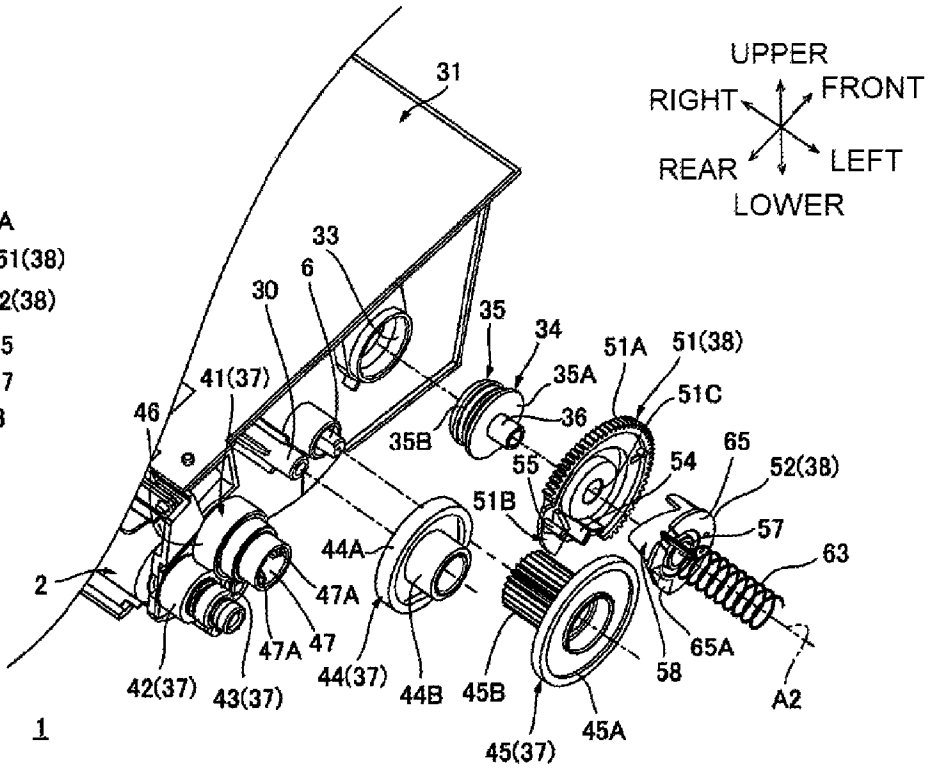
FIG. 3B is an exploded perspective view of the developing cartridge shown in FIG. 3A, as seen from a left-rear side.

The developing frame 31 has a substantially box shape, as shown in FIG. 3B. The developing frame 31 has the toner accommodating portion 5 and supports the developing roller 2, the supply roller 3, the layer thickness regulation blade 4 and the agitator 6. The developing frame 31 has an idle gear support shaft 30, a toner filling port 33, which is an example of the filling port, and a toner cap 34, which is an example of the closing member.

The idle gear support shaft 30 is arranged at a substantially center of an upper end portion of a left wall of the developing frame 31 in the front-rear direction. The idle gear support shaft 30 has a substantially cylindrical shape extending leftward from the left wall of the developing frame 31. The idle gear support shaft 30 is provided integrally for the left wall of the developing frame 31.

The toner filling port 33 is arranged at a front end portion of the left wall of the developing frame 31. The toner filling port 33 has a substantially circular shape, in a side view, and penetrates the left wall of the developing frame 31 in the left-right direction.

The toner cap 34 is fitted in the toner filling port 33 to close the toner filling port 33. The toner cap 34 has a cap main body 35, and a support shaft 36, which is an example of the second support part.

The cap main body 35 has a substantially cylindrical shape extending in the left-right direction and having a closed left end portion. The cap main body 35 has a closing part 35A and an insertion part 35B.

The closing part 35A is arranged at the left end portion of the cap main body 35. The closing part 35A has a substantially disc shape having a thickness in the left-right direction. An outer diameter of the closing part 35A is greater than an inner diameter of the toner filling port 33.

The insertion part 35B has a substantially cylindrical shape extending rightward from a right surface of the closing part 35A. An outer diameter of the insertion part 35B is smaller than the outer diameter of the closing part 35A and slightly greater than the inner diameter of the toner filling port 33. The insertion part 35B is inserted into the toner filling port 33.

The support shaft 36 has a substantially cylindrical shape extending leftward from a substantially center of the left surface of the closing part 35A. A left end portion of the support shaft 36 is opened.

(ii) Driving Unit

Figure 3A:
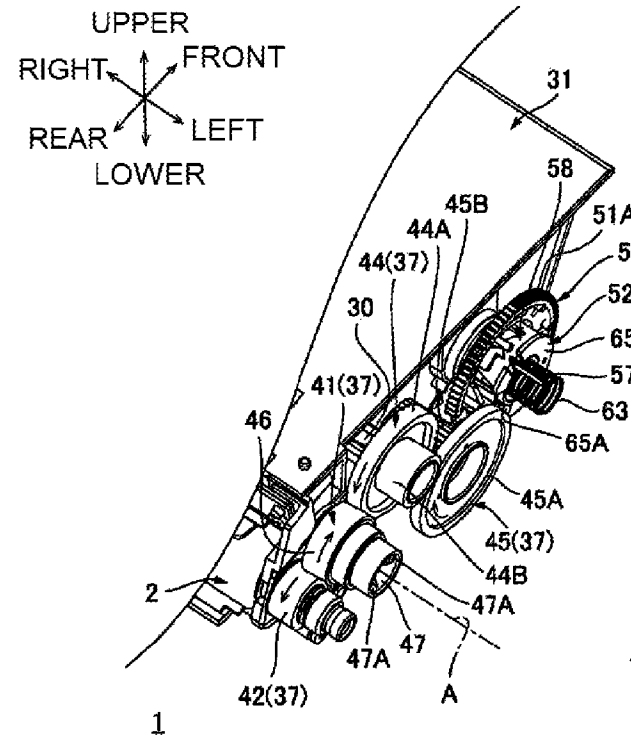
FIG. 3A is a perspective view of the developing cartridge shown in FIG. 1 with a gear cover being detached, as seen from a left-rear side.

As shown in FIGS. 1 and 3A, the driving unit 32 is arranged at the left of the developing frame 31 at the left end portion of the developing cartridge 1. The driving unit 32 has a gear train 37, a detection unit 38, a gear cover 39, which is an example of the covering member, and a compression spring 63, which is an example of the urging member.

(ii-1) Gear Train

As shown in FIGS. 3A and 3B, the gear train 37 has a developing coupling 41, which is an example of the driving receiving part, a developing gear 42, a supply gear 43, an idle gear 44, and an agitator gear 45, which is an example of the transmission member.

The developing coupling 41 is arranged at a rear end portion of the developing cartridge 1. The developing coupling 41 has a substantially cylindrical shape extending in the left-right direction. The developing coupling 41 is rotatably supported by a support shaft (not shown) provided integrally for the left wall of the developing frame 31. The developing coupling 41 has a gear part 46 and a coupling part 47.

The gear part 46 is arranged at a substantially right half part of the developing coupling 41. The gear part 46 has a substantially cylindrical shape extending in the left-right direction and having a closed left end portion. A central axis A1 of the gear part 46 extends in the left-right direction. The central axis A1 of the gear part 46 is an example of the rotational axis. The gear part 46 has gear teeth over an entire circumference thereof.

The coupling part 47 has a substantially cylindrical shape extending leftward from a left wall of the gear part 46 and having an opened left end portion. The coupling part 47 shares the central axis A1 with the gear part 46. The coupling part 47 has a pair of protrusions 47A.

The pair of protrusions 47A is respectively arranged at an interval from each other in a diametrical direction of the coupling part 47 in an inner space 47B of the coupling part 47 in the diametrical direction. Each of the pair of protrusions 47A protrudes inward, in the diametrical direction, from an inner peripheral surface of the coupling part 47, and has a substantially rectangular shape, in a side view.

The developing gear 42 is arranged at a rear-lower side of the developing coupling 41. The developing gear 42 has a substantially disc shape having a thickness in the left-right direction. The developing gear 42 has gear teeth over an entire circumference thereof. The developing gear 42 is supported by a left end portion of a rotary shaft of the developing roller 2 so that it cannot be relatively rotated. The developing gear 42 is engaged with a rear lower end portion of the gear part 46 of the developing coupling 41.

The supply gear 43 is arranged below the developing coupling 41. The supply gear 43 has a substantially disc shape having a thickness in the left-right direction. The supply gear 43 has gear teeth over an entire circumference thereof. The supply gear 43 is supported by a left end portion of a rotary shaft of the supply roller 3 so that it cannot be relatively rotated. The supply gear 43 is engaged with a lower end portion of the gear part 46 of the developing coupling 41.

The idle gear 44 is arranged at a front-upper side of the developing coupling 41. The idle gear 44 is rotatably supported by the idle gear support shaft 30. The idle gear 44 integrally has a large diameter gear 44A and a small diameter gear 44B.

The large diameter gear 44A is arranged at a right end portion of the idle gear 44. The large diameter gear 44A has a substantially disc shape having a thickness in the left-right direction. The large diameter gear 44A has gear teeth over an entire circumference thereof. The large diameter gear 44A is engaged with a front upper end portion of the gear part 46 of the developing coupling 41.

The small diameter gear 44B has a substantially cylindrical shape extending leftward from a left surface of the large diameter gear 44A. The small diameter gear 44B shares a central axis with the large diameter gear 44A. An outer diameter of the small diameter gear 44B is smaller than an outer diameter of the large diameter gear 44A. The small diameter gear 44B has gear teeth over an entire circumference thereof.

Figure 7A:
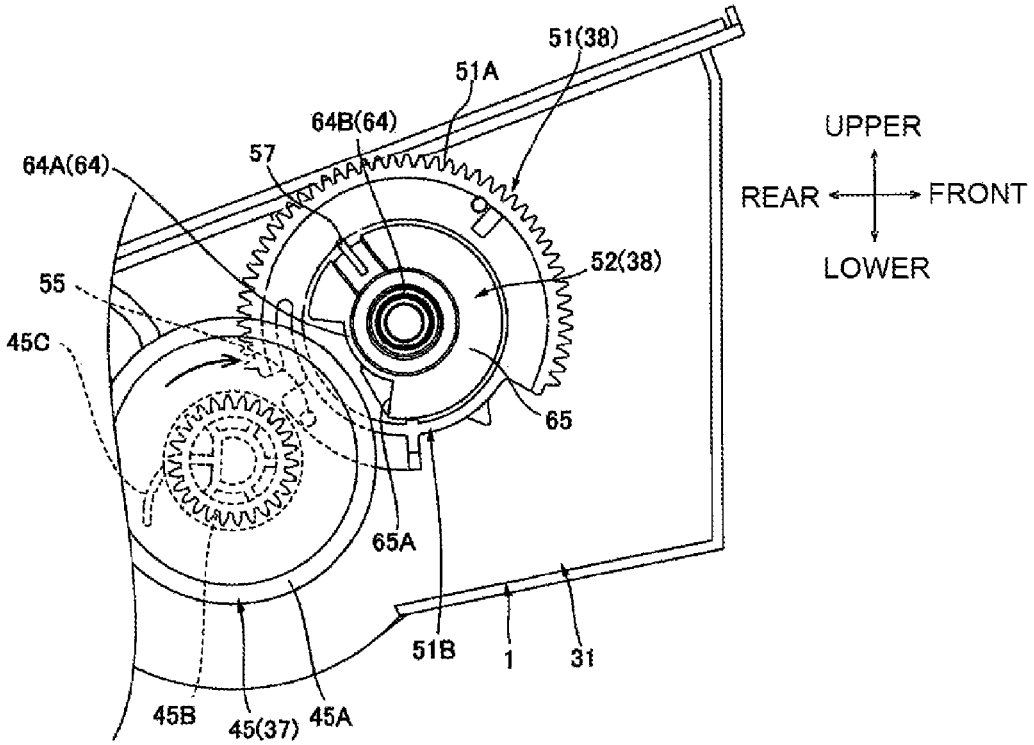
FIG. 7A is an illustration view for illustrating a state where a toothless gear is arranged at a stop position.

The agitator gear 45 is arranged at a front-lower side of the idle gear 44. The agitator gear 45 is supported by a left end portion of a rotary shaft of the agitator 6 so that it cannot be relatively rotated. The agitator gear 45 has a first gear part 45A, a second gear part 45B, which is an example of the transmitting part, and an abutting rib 45C, which is an example of the engaging part, as shown in FIGS. 3B and 7A.

The first gear part 45A is arranged at a left end portion of the agitator gear 45. The first gear part 45A has a substantially disc shape having a thickness in the left-right direction. The first gear part 45A has gear teeth over an entire circumference thereof. The first gear part 45A is engaged with a front lower end portion of the small diameter gear 44B of the idle gear 44.

The second gear part 45B has a substantially cylindrical shape extending rightward from a right surface of the first gear part 45A. The second gear part 45B shares a central axis with the first gear part 45A. An outer diameter of the second gear part 45B is smaller than an outer diameter of the first gear part 45A. The second gear part 45B has gear teeth over an entire circumference thereof. The second gear part 45B has an interval from the large diameter gear 44A of the idle gear 44.

The abutting rib 45C protrudes rightwards from the right surface of the first gear part 45A at an outer side than the second gear part 45B in the diametrical direction. The abutting rib 45C extends so that it is inclined in a counterclockwise direction towards the outer side of the agitator gear 45 in the diametrical direction, as seen from the left side, and has a substantially flat plate shape.

(ii-2) Detection Unit

The detection unit 38 has a toothless gear 51, which is an example of the rotary member, and a detection member 52, which is an example of the detected member.

(ii-2-1) Toothless Gear

The toothless gear 51 has a substantially disc shape having a thickness in the left-right direction. The toothless gear 51 has a teeth part 51A, which is an example of the transmitted part, a toothless part 51B, and an insertion hole 51C.

The teeth part 51A is a part occupying about two-thirds (⅔) of the toothless gear 51 in a circumferential direction, and corresponds to a fan-shaped part having a central angle of about 240° of the toothless gear 51, in a side view. The teeth part 51A has gear teeth over an entire circumference thereof.

The toothless part 51B is a part occupying about one-third (⅓) of the toothless gear 51 in the circumferential direction, except for the teeth part 51A, and corresponds to a fan-shaped part having a central angle of about 120° of the toothless gear 51, in a side view. The toothless part 51B does not have gear teeth. The toothless part 51B has a boss 55, which is an example of the engaged part, and a slide part 54, which is an example of the operating part.

The boss 55 is arranged at an upstream end portion of the toothless part 51B in the counterclockwise direction, as seen from the left side. The boss 55 has a substantially cylindrical shape protruding leftward from a left surface of the toothless part 51B.

The slide part 54 is arranged at an inner side of the boss 55 in the diametrical direction and at a downstream side thereof in the counterclockwise direction, as seen from the left side. The slide part 54 has a substantially flat plate shape protruding leftward from the left surface of the toothless part 51B and extending in the diametrical direction of the toothless gear 51.

The insertion hole 51C is arranged at a central portion of the toothless gear 51 in the diametrical direction. The insertion hole 51C penetrates the toothless gear 51 in the left-right direction, and has a substantially circular shape, in a side view. An inner diameter of the insertion hole 51C is substantially the same as an outer diameter of the support shaft 36 of the toner cap 34.

(ii-2-2) Detection Member

A plurality of types of the detection member 52 is prepared depending on the specification of the developing cartridge 1. Each of the plurality of types of the detection member 52 is mounted to the developing cartridge 1, depending on the maximum number of image formation sheets of the developing cartridge 1, which is an example of the specification of the developing cartridge 1, for example.

Specifically, a first detection member 52A of the plurality of types of the detection member 52 is mounted to the developing cartridge 1 of which the maximum number of image formation sheets is 6,000 sheets. A second detection member 52B of the plurality of types of the detection member 52 is mounted to the developing cartridge 1 of which the maximum number of image formation sheets is 3,000 sheets.

Figure 4A:
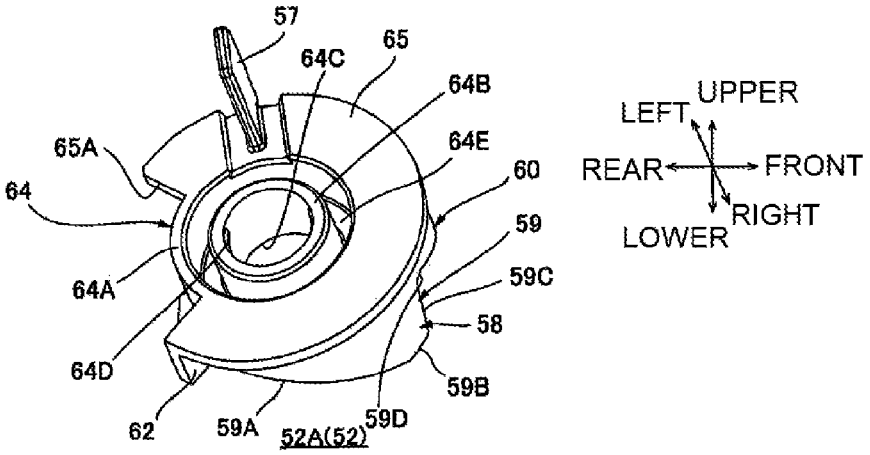
FIG. 4A is a perspective view of a first detection member shown in FIG. 3, as seen from a left-lower side.
Figure 4B:
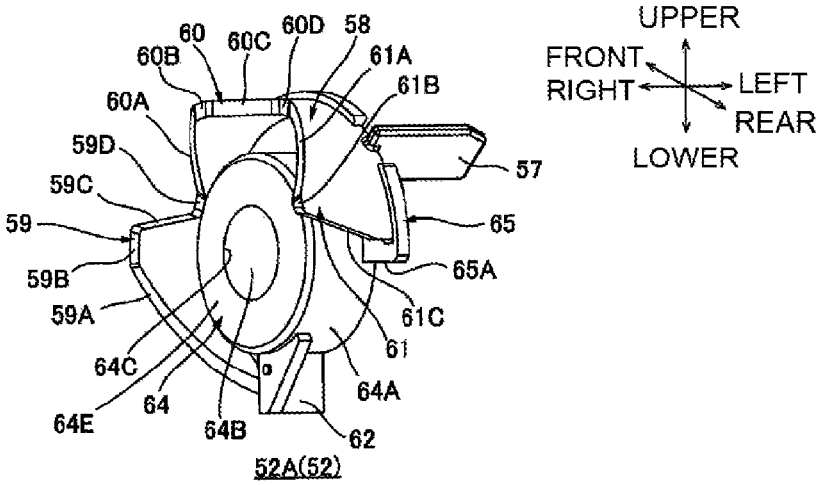
FIG. 4B is a perspective view of the first detection member shown in FIG. 4A, as seen from a rear-lower side.

As shown in FIGS. 4A and 4B, the first detection member 52A has a substantially cylindrical shape extending in the left-right direction. The first detection member 52A has a cylindrical part 64, a collar part 65, a detection projection 57, a displacement part 58, which is an example of the abutment part, and a stopper 62.

The cylindrical part 64 is arranged at a substantially diametrical center of the detection member 52. The cylindrical part 64 has an outer cylinder 64A and an inner cylinder 64B.

The outer cylinder 64A has a substantially cylindrical shape extending in the left-right direction and having a closed right end portion. The outer cylinder 64A has an insertion hole 64C.

The insertion hole 64C is arranged at a central portion of a right wall 64E of the outer cylinder 64A in the diametrical direction. The insertion hole 64C penetrates the right wall 64E of the outer cylinder 64A in the left-right direction and has a substantially circular shape, in a side view. A center of the insertion hole 64C coincides with a central axis of the outer cylinder 64A, when projected in the left-right direction.

Figure 4C:
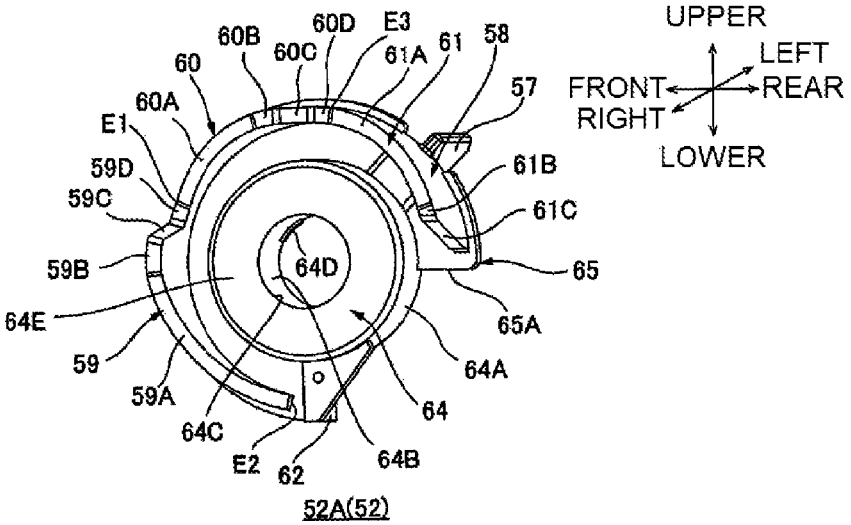
FIG. 4C is a perspective view of the first detection member shown in FIG. 4B, as seen from a right-rear side.

The inner cylinder 64B is arranged at an inner side of the outer cylinder 64A in the diametrical direction. The inner cylinder 64B extends leftward continuously from a peripheral edge part of the insertion hole 64C at the diametrical center of the right wall 64E of the outer cylinder 64A, and has a substantially cylindrical shape. A central axis of the inner cylinder 64B coincides with the central axis of the outer cylinder 64A. An inner diameter of the inner cylinder 64B is the same as an inner diameter of the insertion hole 64C. As shown in FIG. 4C, the inner cylinder 64B has a pair of engaging projections 64D.

The pair of engaging projections 64D is respectively arranged on both inner surfaces of the inner cylinder 64B in the diametrical direction. Each of the pair of engaging projections 64D is a protrusion protruding inward, in the diametrical direction, from the inner surface of the inner cylinder 64B and extending circumferentially.

The collar part 65 protrudes outward, in the diametrical direction, from an outer surface of a left end portion of the outer cylinder 64A in the diametrical direction and extends in the circumferential direction of the outer cylinder 64A. The collar part 65 has a substantially C-shaped plate shape of which a rear end portion is notched over about a quarter (¼) thereof in the circumferential direction, in a side view. In other words, a notched portion 65A of the collar part 65 is notched forward from a rear end edge of the collar part 65. The notched portion 65A of the collar part 65 is an example of the notched portion of the detection member 52.

The detection projection 57 is arranged at an upper end portion of the collar part 65. The detection projection 57 has a substantially flat plate shape protruding leftward from the left surface of the collar part 65 and extending in the diametrical direction of the detection member 52.

As shown in FIGS. 4B and 4C, the displacement part 58 is arranged at the peripheral edge part of the collar part 65. The displacement part 58 has a substantially C-shaped flat plate shape protruding rightward from the right surface of the peripheral edge part of the collar part 65 and extending in the circumferential direction of the collar part 65. The displacement part 58 has a first displacement part 59, a second displacement part 60, and a third displacement part 61.

The first displacement part 59 is arranged at an upstream end portion of the displacement part 58 in the counterclockwise direction, as seen from the left side. The first displacement part 59 has a first inclined surface 59A, which is an example of the inclined part and the first inclined part, a first parallel surface 59B, a second inclined surface 59C and a second parallel surface 59D.

The first inclined surface 59A is arranged at an upstream end portion of the first displacement part 59 in the counterclockwise direction, as seen from the left side. The first inclined surface 59A continues to the right surface of the collar part 65 and is inclined rightward towards the downstream side in the counterclockwise direction, as seen from the left side.

The first parallel surface 59B continues to a downstream side of the first inclined surface 59A in the counterclockwise direction, as seen from the left side, and extends in the counterclockwise direction, as seen from the left side. The first parallel surface 59B is parallel with the right surface of the collar part 65 so that a distance thereof from the right surface of the collar part 65 in the left-right direction is constant.

The second inclined surface 59C continues to a downstream side of the first parallel surface 59B in the counterclockwise direction, as seen from the left side, and is inclined leftward towards the downstream side in the counterclockwise direction, as seen from the left side.

The second parallel surface 59D continues to a downstream side of the first second inclined surface 59C in the counterclockwise direction, as seen from the left side. The second parallel surface 59D is parallel with the right surface of the collar part 65 so that a distance thereof from the right surface of the collar part 65 in the left-right direction is constant.

The second displacement part 60 is arranged to continue to a downstream side of the first displacement part 59 in the counterclockwise direction, as seen from the left side. The second displacement part 60 has a first inclined surface 60A, which is an example of the inclined part and the second inclined part, a first parallel surface 60B, a second inclined surface 60C, and a second parallel surface 60D.

The first inclined surface 60A is arranged at an upstream end portion of the second displacement part 60 in the counterclockwise direction, as seen from the left side. The first inclined surface 60A continues to the second parallel surface 59D of the first displacement part 59, and is inclined rightward towards the downstream side in the counterclockwise direction, as seen from the left side. An upstream end portion E1 of the first inclined surface 60A in the counterclockwise direction, as seen from the left side, is positioned at the right of an upstream end portion E2 of the first inclined surface 59A of the first displacement part 59 in the counterclockwise direction, as seen from the left side.

The first parallel surface 60B continues to a downstream side of the first inclined surface 60A in the counterclockwise direction, as seen from the left side, and extends in the counterclockwise direction, as seen from the left side. The first parallel surface 60B is parallel with the right surface of the collar part 65 so that a distance thereof from the right surface of the collar part 65 in the left-right direction is constant.

The second inclined surface 60C continues to a downstream side of the first parallel surface 60B in the counterclockwise direction, as seen from the left side, and is inclined leftward towards the downstream side in the counterclockwise direction, as seen from the left side.

The second parallel surface 60D continues to a downstream side of the second inclined surface 60C in the counterclockwise direction, as seen from the left side, and extends in the counterclockwise direction, as seen from the left side. The second parallel surface 60D is parallel with the right surface of the collar part 65 so that a distance thereof from the right surface of the collar part 65 in the left-right direction is constant.

The third displacement part 61 is arranged to continue to a downstream side of the second displacement part 60 in the counterclockwise direction, as seen from the left side. The third displacement part 61 has a first inclined surface 61A, which is an example of the inclined part and the second inclined part, a parallel surface 61B, and a second inclined surface 61C.

The first inclined surface 61A is arranged at an upstream end portion of the third displacement part 61 in the counterclockwise direction, as seen from the left side. The first inclined surface 61A continues to the second parallel surface 60D of the second displacement part 60 and is inclined rightward towards the downstream side in the counterclockwise direction, as seen from the left side. An upstream end portion E3 of the first inclined surface 61A in the counterclockwise direction, as seen from the left side, is located at the same position as the upstream end portion E1 of the first inclined surface 60A of the second displacement part 60 in the counterclockwise direction, as seen from the left side.

The parallel surface 61B continues to a downstream side of the first inclined surface 61A in the counterclockwise direction, as seen from the left side, and extends in the counterclockwise direction, as seen from the left side. The parallel surface 61B is parallel with the right surface of the collar part 65 so that a distance thereof from the right surface of the collar part 65 in the left-right direction is constant.

The second inclined surface 61C continues to a downstream side of the parallel surface 61B in the counterclockwise direction, as seen from the left side, and is inclined leftward towards the downstream side in the counterclockwise direction, as seen from the left side.

Figure 5A:
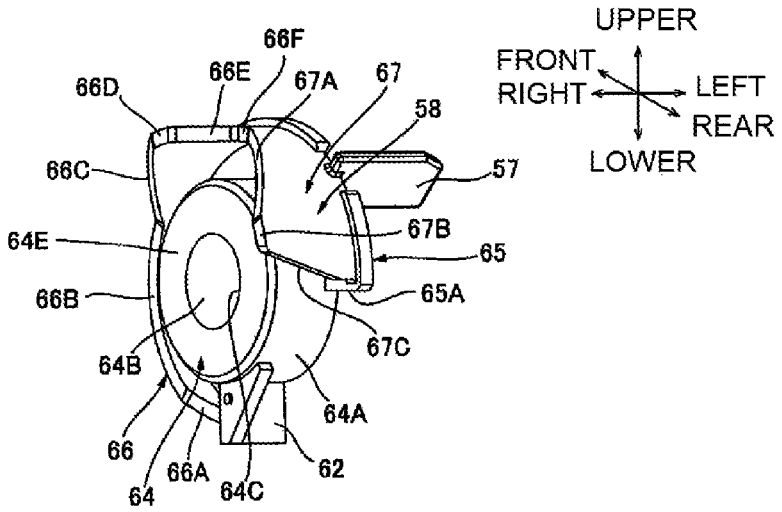
FIG. 5A is a perspective view of a second detection member, as seen from a rear-lower side.
Figure 5B:
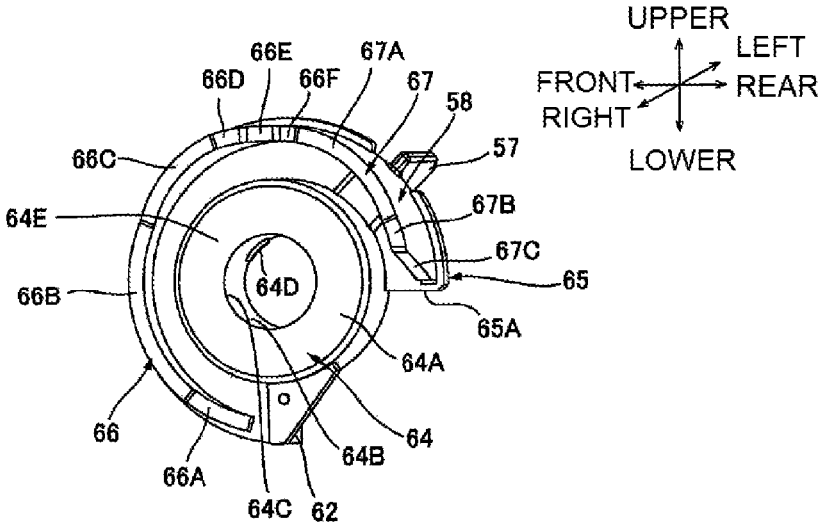
FIG. 5B is a perspective view of the second detection member shown in FIG. 5A, as seen from a right-rear side.

The stopper 62 has a substantially flat plate shape protruding rightward from the upstream end portion of the collar part 65 in the counterclockwise direction, as seen from the left side, and extending in the diametrical direction of the collar part 65. The stopper 62 faces the first inclined surface 59A of the first displacement part 59 at an interval therebetween at an upstream side in the counterclockwise direction, as seen from the left side As shown in FIGS. 5A and 5B, the second detection member 52B the same shape as the first detection member 52A, except for the shape of the displacement part 58.

The displacement part 58 of the second detection member 52B has a first displacement part 66 and a second displacement part 67.

The first displacement part 66 is a part occupying about two-thirds (⅔) of an upstream side of the displacement part 58 in the counterclockwise direction, as seen from the left side. The first displacement part 66 has a first inclined surface 66A, a first parallel surface 66B, a second inclined surface 66C, a second parallel surface 66D, a third inclined surface 66E and a third parallel surface 66F.

The first inclined surface 66A is arranged at an upstream end portion of the first displacement part 66 in the counterclockwise direction, as seen from the left side. The first inclined surface 66A continues to the right surface of the collar part 65 and is inclined rightward towards the downstream side in the counterclockwise direction, as seen from the left side.

The first parallel surface 66B continues to a downstream side of the first inclined surface 66A in the counterclockwise direction, as seen from the left side, and extends in the counterclockwise direction, as seen from the left side. The first parallel surface 66B is parallel with the right surface of the collar part 65 so that a distance thereof from the right surface of the collar part 65 in the left-right direction is constant.

The second inclined surface 66C continues to a downstream side of the first parallel surface 66B in the counterclockwise direction, as seen from the left side, and is inclined rightward towards the downstream side in the counterclockwise direction, as seen from the left side. The second inclined surface 66C configures the first inclined part together with the first inclined surface 66A.

The second parallel surface 66D continues to a downstream side of the second inclined surface 66C in the counterclockwise direction, as seen from the left side, and extends in the counterclockwise direction, as seen from the left side. The second parallel surface 66D is parallel with the right surface of the collar part 65 so that a distance thereof from the right surface of the collar part 65 in the left-right direction is constant.

The third inclined surface 66E continues to a downstream side of the second parallel surface 66D in the counterclockwise direction, as seen from the left side, and is inclined leftward towards the downstream side in the counterclockwise direction, as seen from the left side.

The third parallel surface 66F continues to a downstream side of the third inclined surface 66E in the counterclockwise direction, as seen from the left side, and extends in the counterclockwise direction, as seen from the left side. The third parallel surface 66F is parallel with the right surface of the collar part 65 so that a distance thereof from the right surface of the collar part 65 in the left-right direction is constant.

The second displacement part 67 is arranged to continue to a downstream side of the first displacement part 66 in the counterclockwise direction, as seen from the left side, and has the same shape as the third displacement part 61 of the first detection member 52A. Specifically, the second displacement part 67 has a first inclined surface 67A, a parallel surface 67B and a second inclined surface 67C.

The first inclined surface 67A is arranged at an upstream end portion of the second displacement part 67 in the counterclockwise direction, as seen from the left side. The first inclined surface 67A continues to the third parallel surface 66F of the first displacement part 66 and is inclined rightward towards the downstream side in the counterclockwise direction, as seen from the left side.

The parallel surface 67B continues to a downstream side of the first inclined surface 67A in the counterclockwise direction, as seen from the left side, and extends in the counterclockwise direction, as seen from the left side. The parallel surface 67B is parallel with the right surface of the collar part 65 so that a distance thereof from the right surface of the collar part 65 in the left-right direction is constant.

The second inclined surface 67C continues to a downstream side of the parallel surface 67B in the counterclockwise direction, as seen from the left side, and is inclined leftward towards the downstream side in the counterclockwise direction, as seen from the left side.

(ii-3) Gear Cover and Compression Spring

Figure 6:
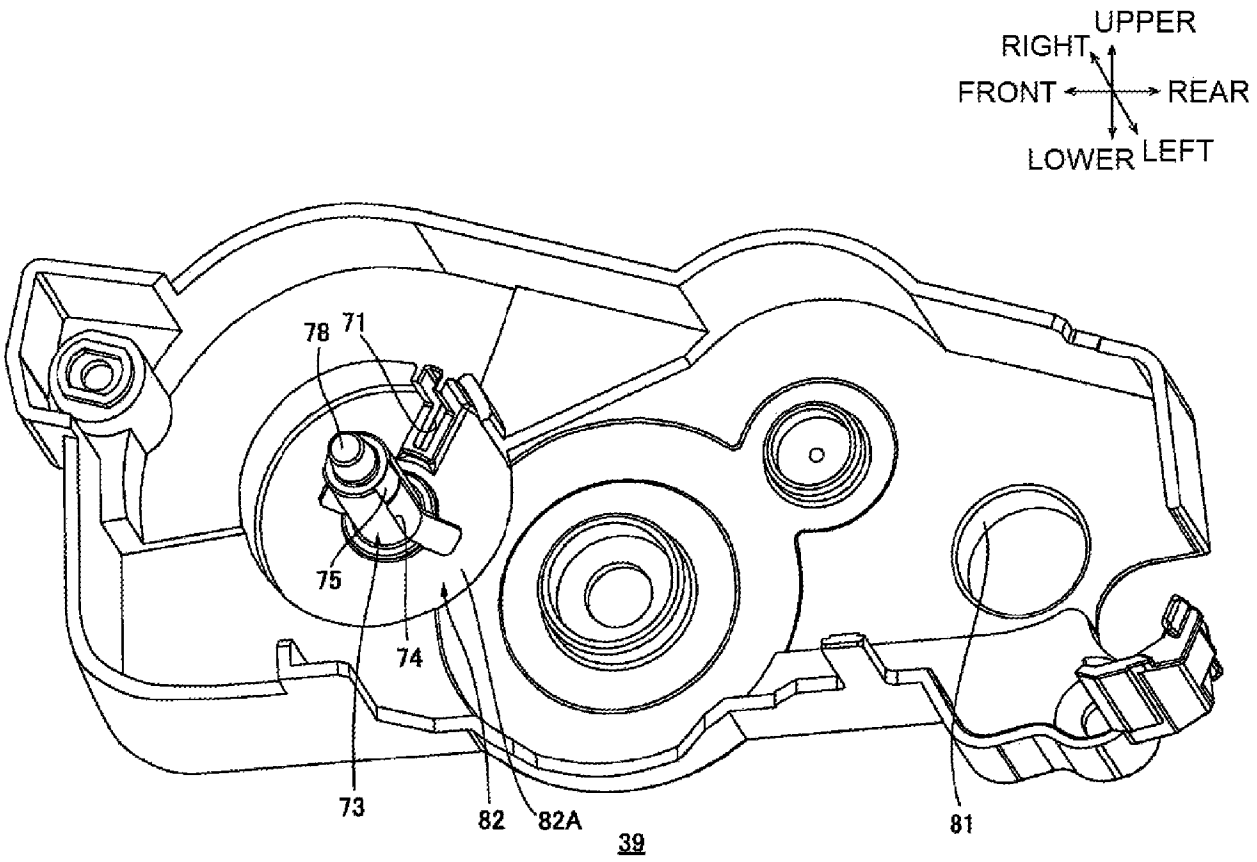
FIG. 6 is a perspective view of the gear cover shown in FIG. 1, as seen from a right-lower side.

As shown in FIGS. 1 and 6, the gear cover 39 is supported by the left end portion of the developing frame 31. The gear cover 39 has a substantially square tube shape extending in the left-right direction and having a closed left end portion. The gear cover 39 covers the gear train 37 and the detection unit 38. The gear cover 39 has a coupling collar 81 and a detection member accommodation part 82.

The coupling collar 81 is arranged at a rear end portion of the gear cover 39. The coupling collar 81 has a substantially cylindrical shape penetrating a left wall of the gear cover 39 and extending in the left-right direction. An inner diameter of the coupling collar 81 is substantially the same as an outer diameter of the coupling part 47 of the developing coupling 41. The coupling part 47 of the developing coupling 41 is rotatably fitted in the coupling collar 81.

The detection member accommodation part 82 is arranged at a front end portion of the gear cover 39. The detection member accommodation part 82 has a substantially cylindrical shape extending leftward from a left surface of the gear cover 39 and having a closed left end portion. A left wall 82A of the detection member accommodation part 82 is an example of the covering part. In the meantime, a right end portion of the detection member accommodation part 82 communicates with an inside of the gear cover 39. The detection member accommodation part 82 accommodates therein the detection member 52. The detection member accommodation part 82 has a slit 71, and a support shaft 73, which is an example of the first support part.

The slit 71 is arranged at an upper end portion of the detection member accommodation part 82. The slit 71 penetrates the left wall 82A of the detection member accommodation part 82 in the left-right direction and extends in a diametrical direction of the detection member accommodation part 82.

The support shaft 73 has a substantially cylindrical shape extending rightward from a diametrical center of the left wall 82A of the detection member accommodation part 82. An outer diameter of the support shaft 73 is the same as the inner diameter of the insertion hole 64C of the detection member 52. The support shaft 73 has guide recesses 74, engaging claws 75 and a protrusion 78.

The guide recesses 74 are arranged at both end portions of the support shaft 73 in the front-rear direction. The guide recess 74 is recessed inward, in the diametrical direction, from an outer peripheral surface of the support shaft 73 and extends in the left-right direction.

The engaging claw 75 is arranged in a right end portion of the guide recess 74. The engaging claw 75 protrudes outward, in the diametrical direction, from an inner surface of the guide recess 74 in the diametrical direction. An outer surface of the engaging claw 75 in the diametrical direction is inclined towards the outer side in the diametrical direction towards the left side.

The protrusion 78 is arranged at a right end portion of the support shaft 73. The protrusion 78 has a substantially cylindrical shape protruding rightward from a right surface of the support shaft 73 and having a diameter that is gradually decreased as the protrusion faces rightward. The protrusion 78 is fitted in a left end portion of the support shaft 36 (see FIG. 8A) of the toner cap 34. Thereby, the support shaft 73 of the gear cover 39 configures a support part, together with the support shaft 36 of the toner cap 34.

Figure 8A:
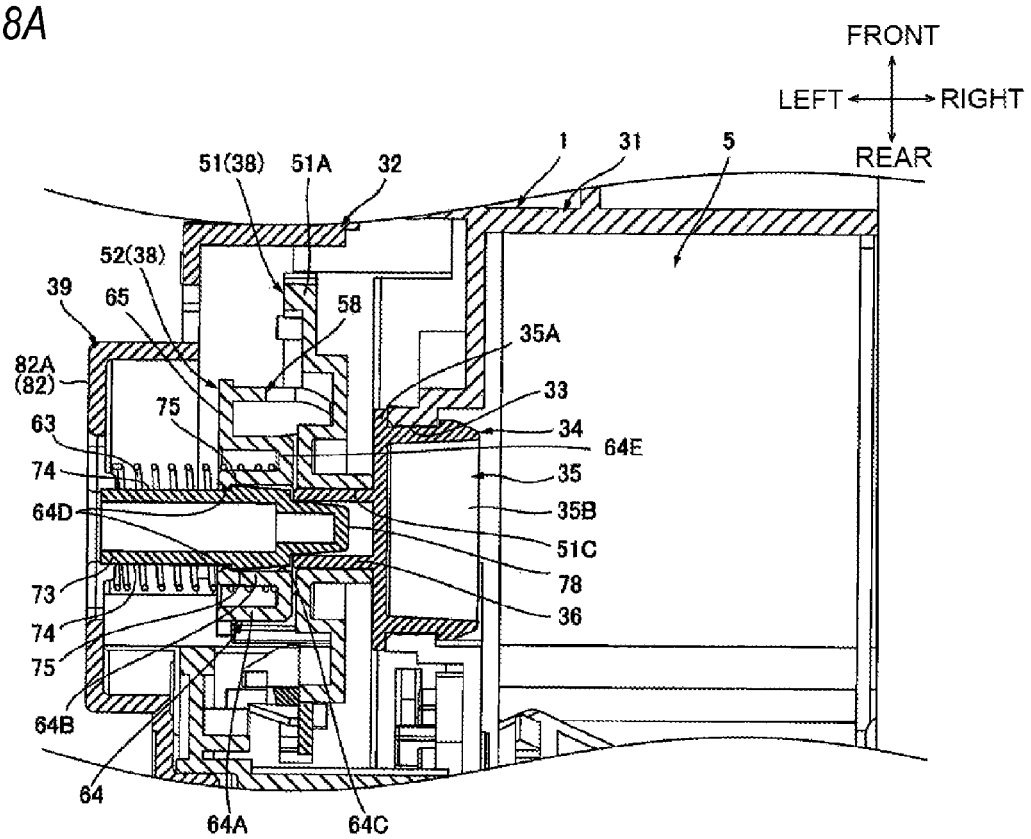
FIG. 8A is a sectional view taken along a line A-A of FIG. 1.

As shown in FIGS. 3A and 8A, the compression spring 63 is a coil spring extending in the left-right direction. A left end portion of the compression spring 63 abuts on the left wall 82A of the detection member accommodation part 82 of the gear cover 39. A right end portion of the compression spring 63 abuts on the right wall of the outer cylinder 64A of the detection member 52. Thereby, the compression spring 63 always urges rightward the detection member 52 towards the developing frame 31.

(ii-4) Mounted State of Detection Unit

Hereinafter, a mounted state of the detection unit 38 is described. In the meantime, the two types of the detection member 52 (the first detection member 52A and the second detection member 52B) are respectively mounted to the developing cartridge 1 at the same mounted state. For this reason, in the below, the first detection member 52A of the two types of the detection member 52 is described.

As shown in FIG. 8A, the toothless gear 51 is rotatably supported by the support shaft 36 of the toner cap 34. The support shaft 36 of the toner cap 34 is fitted in the insertion hole 51C of the toothless gear 51 so that it can be relatively rotated.

The detection member 52 is supported by the support shaft 73 of the gear cover 39 so that it cannot rotate and can move in the left-right direction.

The support shaft 73 of the gear cover 39 is fitted in the insertion hole 64C and the inner cylinder 64B of the detection member 52. The engaging projections 64D of the detection member 52 are fitted in the guide recesses 74 at the left of the engaging claws 75. Thereby, the detection member 52 is restrained from further moving rightward.

Also, as shown in FIGS. 1 and 3A, a left end portion of the detection projection 57 is arranged in the slit 71 of the gear cover 39.

Figure 7B:
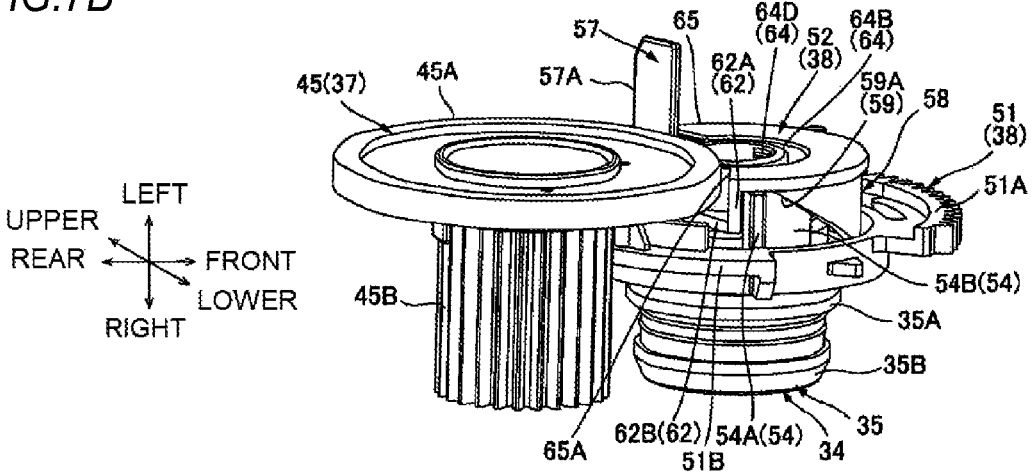
FIG. 7B is an illustrative view for illustrating that the toothless gear is restrained from rotating by a detection member as the state shown in FIG. 7A.

Also, as shown in FIG. 7B, a front end portion of the first gear part 45A of the agitator gear 45 is arranged in the notched portion 65A of the detection member 52.

As shown in FIGS. 3A and 7A, at a state where the developing cartridge 1 is not used yet, i.e., the developing cartridge 1 is a new product, a downstream end portion of the teeth part 51A of the toothless gear 51 in the counterclockwise direction is arranged at an interval above the front of the second gear part 45B of the agitator gear 45, as seen from a left side. A position of the toothless gear 51 at that time is an example of the stop position.

Also, a slide rib 54A of the toothless gear 51 faces the rear of the first inclined surface 59A in front of a stopper rib 62A of the detection member 52. The toothless gear 51 is restrained from rotating in the clockwise direction, as seen from the left side, by the stopper rib 62A and is restrained from rotating in the counterclockwise direction, as seen from the left side, by the first inclined surface 59A. That is, the toothless gear 51 is restrained from rotating at the stop position by the stopper rib 62A and the first displacement part 59.

Figure 8B:
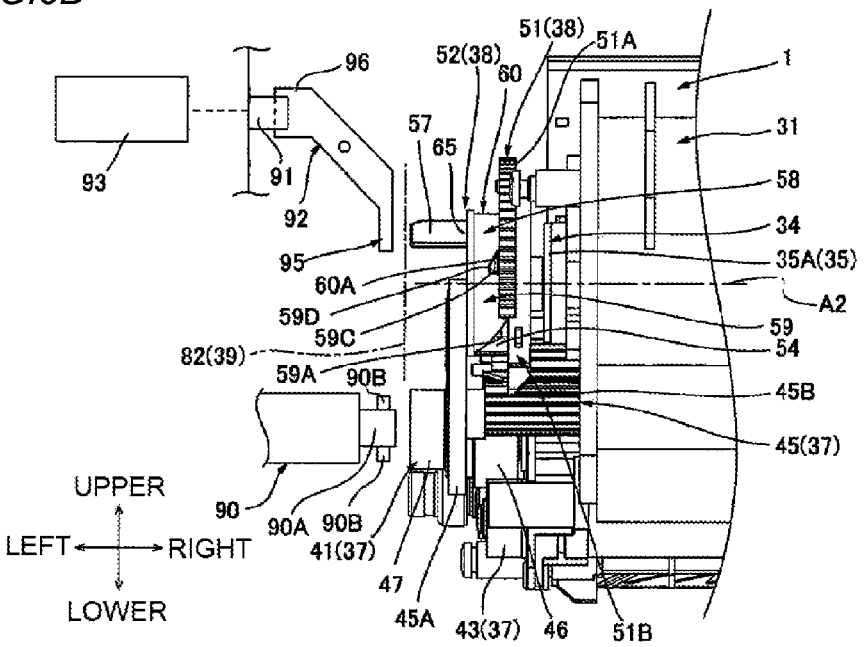
FIG. 8B is a front view of the developing cartridge shown in FIG. 3A.

Also, as shown in FIG. 8B, the slide part 54 of the toothless gear 51 faces the rear of the first inclined surface 59A of the detection member 52, as shown in FIG. 8B. Also, the detection member 52 is located at a retreat position at which the detection projection 57 is retreated into the gear cover 39, which is an example of the first position.

4. Details of Apparatus Main Body

The apparatus main body 12 has a main body coupling 90, an optical sensor 91, an actuator 92, and a control unit 93.

The main body coupling 90 is arranged in the apparatus main body 12 so that it is positioned at the left of the developing cartridge 1. The main body coupling 90 has a substantially cylindrical shape extending in the left-right direction. The main body coupling 90 operates in accordance with the opening/closing operation of the front cover 17 of the apparatus main body 12. That is, when the front cover 17 is opened, the main body coupling 90 is retreated leftward to separate from the developing cartridge 1. When the front cover 17 is closed, the main body coupling 90 is advanced rightward towards the developing cartridge 1. The main body coupling 90 has an engaging part 90A.

The engaging part 90A is arranged at a right end portion of the main body coupling 90. The engaging part 90A has a substantially cylindrical shape protruding rightward from the right end portion of the main body coupling 90. The engaging part 90A is inserted in the inner space 47B of the coupling part 47 of the developing coupling 41 in the diametrical direction, when the main body coupling 90 is advanced towards the developing cartridge 1. The engaging part 90A has a pair of engaging projections 90B.

Each of the pair of engaging projections 90B has a substantially rectangular column shape extending outward, in the diametrical direction, from each of both diametrical surfaces of the engaging part 90A, as seen from the left side. The pair of engaging projections 90B faces the pair of protrusions 47A of the coupling part 47 when the engaging part 90A is inserted into the inner space 47B of the coupling part 47 in the diametrical direction.

The optical sensor 91 is arranged in the apparatus main body 12 so that it is positioned at a left-upper side of the developing cartridge 1. The optical sensor 91 has a light emitting device and a light receiving device facing each other at an interval. The light emitting device always emits detection light towards the light receiving device. The light receiving device receives the detection light emitted from the light emitting device. The optical sensor 91 generates a light receiving signal when the light receiving device receives the detection light, and does not generate a light receiving signal when the light receiving device does not receive the detection light. The optical sensor 91 is electrically connected to the control unit 93.

The actuator 92 is arranged at the right of the optical sensor 91. The actuator 92 has a substantially rod shape extending in left-upper and right-lower directions and is rotatably supported at a predetermined part thereof in the upper-lower direction in the apparatus main body 12. The actuator 92 can be rotated to a non-detection position (see FIG. 8B) at which the detection light of the optical sensor 91 is shielded and a detection position (see FIG. 10A) at which the detection light of the optical sensor 91 is not shielded. The actuator 92 is all the time urged towards the non-detection position by an urging member (not shown). The actuator 92 has a pressed part 95 and a light shielding part 96.

The pressed part 95 is arranged at a right lower end portion of the actuator 92. The pressed part 95 has a substantially flat plate shape extending in the front-rear and upper-lower directions.

The light shielding part 96 is arranged at a left upper end portion of the actuator 92. The light shielding part 96 has a substantially flat plate shape extending in the upper-lower and left-right directions. The light shielding part 96 is positioned between the light emitting device and light receiving device of the optical sensor 91 when the actuator 92 is located at the non-detection position (see FIG. 8B), and is retreated rightward from between the light emitting device and light receiving device of the optical sensor 91 when the actuator 92 is located at the detection position (see FIG. 10A).

The control unit 93 has a circuit board having an application specific integrated circuit (ASIC) and is arranged in the apparatus main body 12. Also, the control unit 93 is configured to count the number of rotations of the developing roller 2.

5. Detection Operation

As shown in FIG. 2, when the process cartridge 13 having the developing cartridge 1 of which a maximum number of image formation sheets is 6,000 sheets is mounted to the apparatus main body 12 and the front cover 17 is closed, the main body coupling 90 (see FIG. 8B) in the apparatus main body 12 is fitted to the developing coupling 41 (see FIG. 8B) so that it cannot be relatively rotated with respect to the developing coupling 41, in accordance with the closing operation of the front cover 17.

After that, the control unit 93 starts a warm-up operation of the image forming apparatus 11.

When the warm-up operation of the image forming apparatus 11 starts, the engaging projections 90B of the main body coupling 90 are engaged with the protrusions 47A of the developing coupling 41.

Then, a driving force is input from the apparatus main body 12 to the developing coupling 41 through the main body coupling 90, and the developing coupling 41 is rotated in the clockwise direction, as seen from the left side, as shown in FIG. 3A.

Then, the developing gear 42, the supply gear 43 and the idle gear 44 are rotated in the counterclockwise direction, as seen from the left side. Thereby, the developing roller 2 and the supply roller 3 are rotated in the counterclockwise direction, as seen from a left side.

Also, when the idle gear 44 is rotated, the agitator gear 45 is rotated in the clockwise direction, as seen from the left side. Thereby, the agitator 6 is rotated in the clockwise direction, as seen from the left side.

Figure 9B:
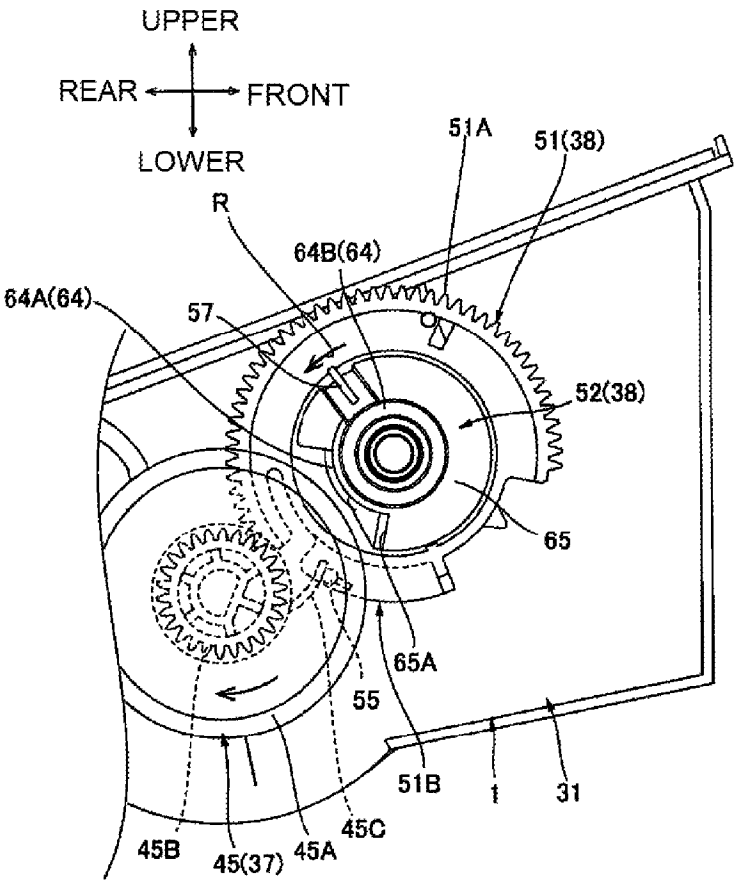
FIG. 9B illustrates the new product detection operation of the developing cartridge subsequent to FIG. 9A, illustrating a state where a teeth part of the toothless gear is engaged with the agitator gear.
Figure 9A:
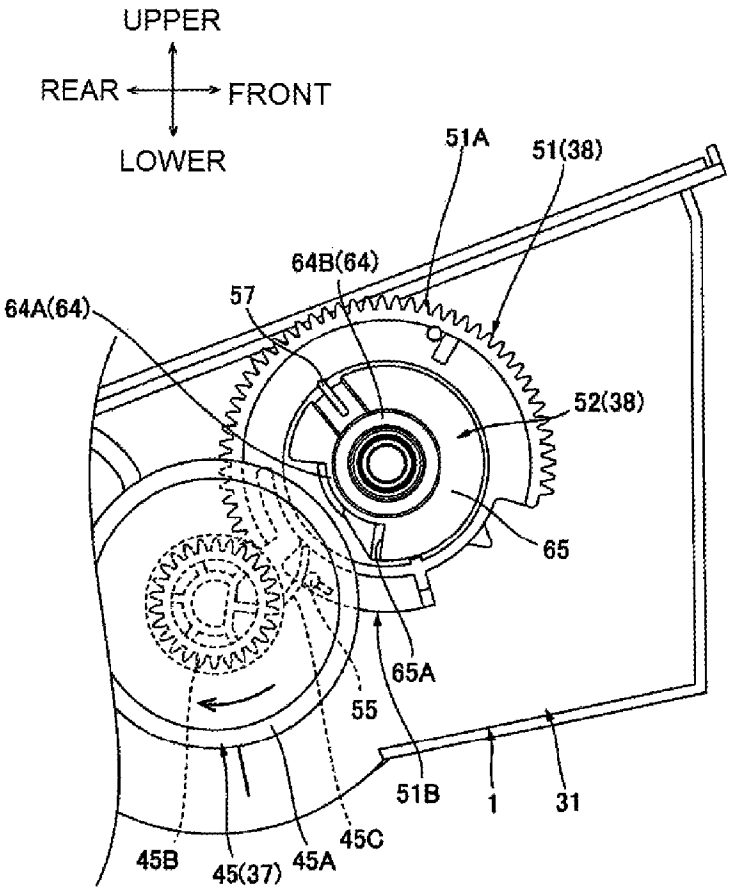
FIG. 9A illustrates a new product detection operation of the developing cartridge, illustrating a state where an abutting rib of an agitator gear abuts on a boss of the toothless gear.

When the agitator gear 45 is rotated, the abutting rib 45C is moved in the clockwise direction, as seen from the left side, in accordance with the rotation of the agitator gear 45, as shown in FIG. 9A. Then, the abutting rib 45C abuts on the boss 55 of the toothless gear 51 from a rear-upper side, thereby pressing the boss 55 in a front-lower direction.

Thereby, the toothless gear 51 is rotated in the counterclockwise direction, as seen from the left side, and is engaged with the front upper end portion of the second gear part 45B of the agitator gear 45 at the gear teeth of the downstream end portion of the teeth part 51A in the counterclockwise direction, as seen from the left side. A position of the toothless gear 51 at that time is an example of the driving position.

Then, the driving force is transmitted from the agitator gear 45 to the toothless gear 51, and the toothless gear 51 is rotated about a central axis A2 of the support shaft 36 in the counterclockwise direction, as seen from the left side. Hereinafter, the counterclockwise direction as seen from the left side is referred to as a rotating direction R.

Then, referring to FIG. 7B, the slide part 54 of the toothless gear 51 abuts on the first inclined surface 59A of the first displacement part 59 of the first detection member 52A from an upstream side in the rotating direction R.

Here, as described above, the left end portion of the detection projection 57 is arranged in the slit 71 (see FIG. 6) of the gear cover 39. Also, the engaging projections 64D of the detection member 52 are fitted in the guide recesses 74 (see FIG. 6).

Thereby, the left end portion of the detection projection 57 abuts on the peripheral edge part of the slit 71 at a downstream side in the rotating direction R and the engaging projections 64D abut on the inner surfaces of the guide recesses 74 in the rotating direction R, so that the detection projection 57 is restrained from being further rotated in the rotating direction R.

When the toothless gear 51 is further rotated, the slide part 54 presses leftward the first inclined surface 59A of the first displacement part 59 with sliding along the first inclined surface 59A in the rotating direction R. Thereby, the first detection member 52A is gradually moved leftward to be away from the developing frame 31 against the urging force of the compression spring 63 with the rotation thereof being restrained.

Then, the detection projection 57 is advanced leftward through the slit 71, abuts on the pressed part 95 of the actuator 92 from right, and presses leftward the pressed part 95. Thereby, the actuator 92 swings from the non-detection position in the clockwise direction, as seen from the front.

Figures 10A, 10B, 10C:
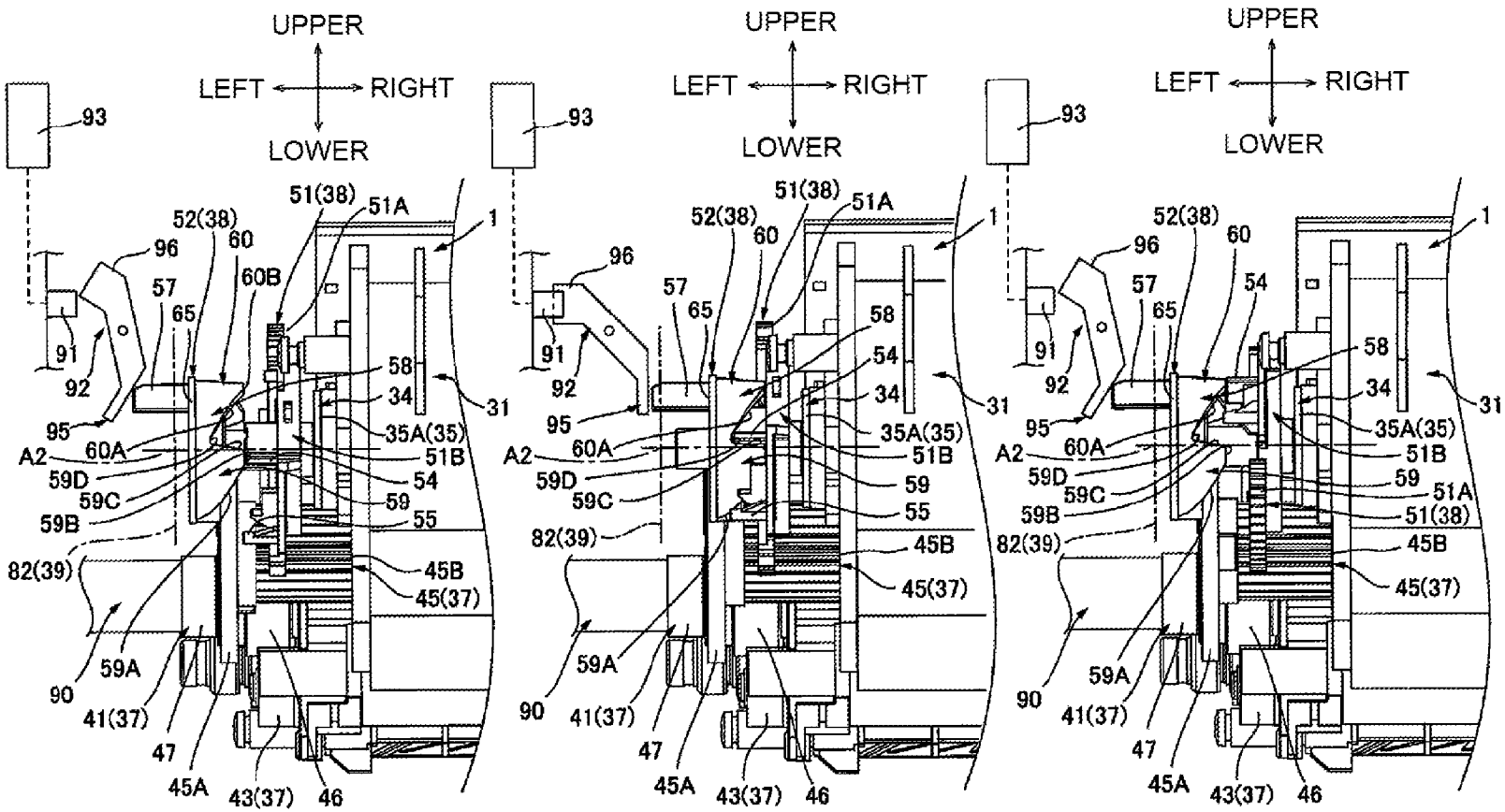
FIG. 10A illustrates the new product detection operation of the developing cartridge subsequent to FIG. 9B, illustrating a state where a slide part of the toothless gear abuts on a first parallel surface of a first displacement part of the detection member, the detection member is located at an advance position, and an actuator is located at a detection position.
FIG. 10B illustrates the new product detection operation of the developing cartridge subsequent to FIG. 10A, illustrating a state where the slide part of the toothless gear abuts on a second parallel surface of the first displacement part, the detection member is located at a standby position, and the actuator is located at a non-detection position.
FIG. 10C illustrates the new product detection operation of the developing cartridge subsequent to FIG. 10B, illustrating a state where the slide part of the toothless gear abuts on a first parallel surface of a second displacement part of the detection member, the detection member is located at the advance position, and the actuator is located at the detection position.
Figure 11:
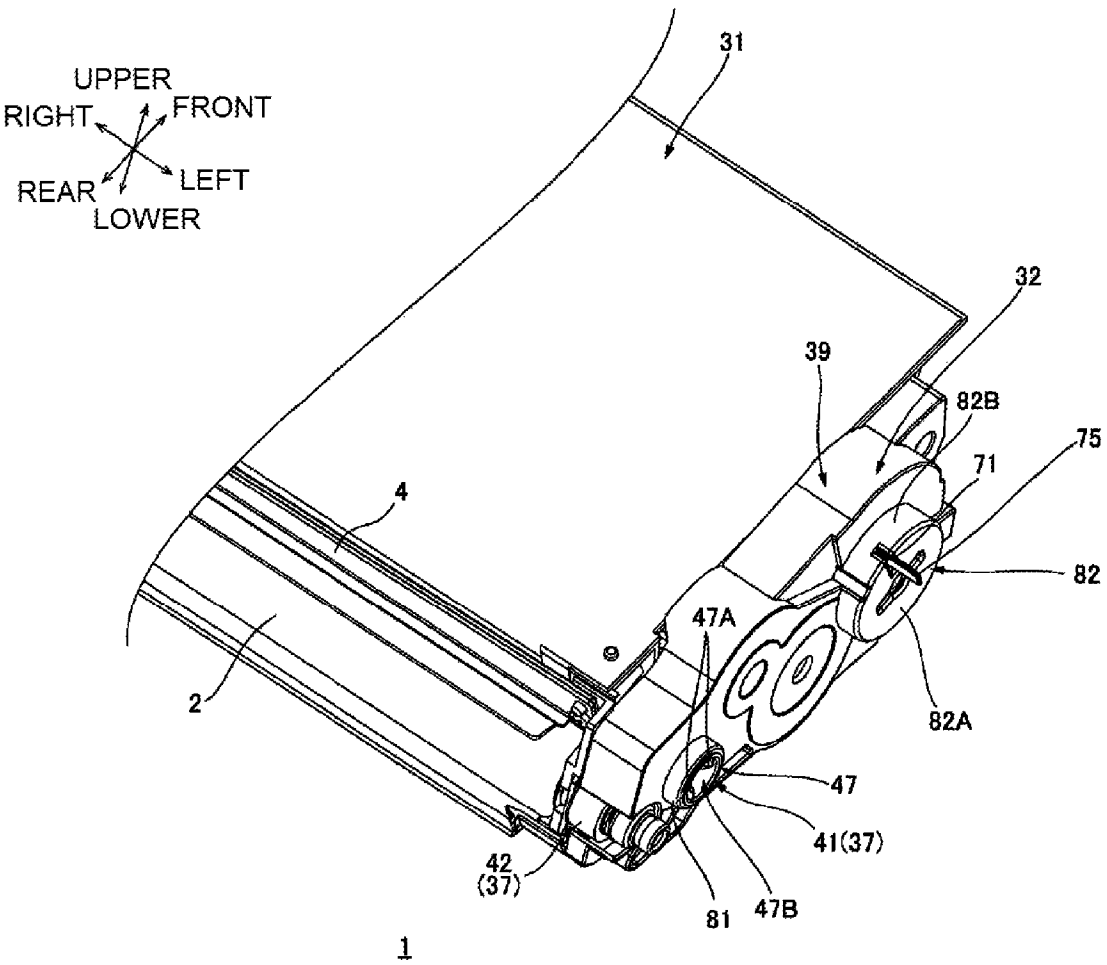
FIG. 11 is a perspective view of the developing cartridge shown in FIG. 10A, as seen from a left-rear side.

Then, when the toothless gear 51 is further rotated, the detection projection 57 is advanced most leftward at the time that the first slide part 54 abuts on the first parallel surface 59B of the first displacement part 59, as shown in FIGS. 10A and 11. A position of the first detection member 52A at that time is an advance position, which is an example of the second position.

At this time, the actuator 92 is located at the detection position. The light shielding part 96 is retreated rightward between the light emitting device and light receiving device of the optical sensor 91. Thereby, the light receiving device of the optical sensor 91 receives the detection light, and the optical sensor 91 outputs a first light receiving signal.

Then, the control unit 93 determines that the unused (new product) developing cartridge 1 has been mounted to the apparatus main body 12, because the light receiving signal is received from the optical sensor 91 within predetermined time after the warm-up operation starts. Thereby, the control unit 93 resets the counted number of rotations of the developing roller 2.

Then, when the toothless gear 51 is further rotated, the slide part 54 abuts on the second inclined surface 59C of the first displacement part 59 and slides on the second inclined surface 59C in the rotating direction R. Then, the first detection member 52A is gradually moved rightward to be close to the developing frame 31 by the urging force of the compression spring 63 with the rotation thereof being restrained.

Thereby, the detection projection 57 is gradually retreated into the gear cover 39 and is spaced leftward from the pressed part 95 of the actuator 92. Then, the actuator 92 swings from the detection position in the counterclockwise direction, as seen from the front, and is located at the non-detection position.

Thereby, the light shielding part 96 of the actuator 92 is positioned between the light emitting device and light receiving device of the optical sensor 91.

Thus, the light receiving device of the optical sensor 91 does not receive the detection light and the optical sensor 91 stops the output of the first light receiving signal.

Then, when the toothless gear 51 is further rotated, the further movement of the first detection member 52A in the leftward direction is stopped at a state where the detection projection 57 is advanced slightly more leftward than the gear cover 39 at the time that the slide part 54 abuts on the second parallel surface 59D of the first displacement part 59, as shown in FIG. 10B. Thereby, the first reciprocating movement of the first detection member 52A is completed. A position of the first detection member 52A at that time is a standby position, which is an example of the third position.

Then, when the toothless gear 51 is further rotated, the slide part 54 abuts on the second displacement part 60 of the first detection member 52A. Then, as shown in FIG. 10C, the first detection member 52A is located at the advance position and is then located at the standby position, like the case where the slide part 54 abuts on the first displacement part 59. Thereby, the second time reciprocating movement of the first detection member 52A is completed. Also, the optical sensor 91 outputs a second time light receiving signal and then stops the output of the second time light receiving signal.

Then, when the toothless gear 51 is further rotated, the slide part 54 abuts on the third displacement part 61 (see FIG. 4A) of the first detection member 52A. Then, the first detection member 52A is located at the advance position and is then retreated rightward, like the case where the slide part 54 abuts on the first displacement part 59. Thereby, the optical sensor 91 outputs a third time light receiving signal and then stops the output of the third time light receiving signal.

Figure 12A:
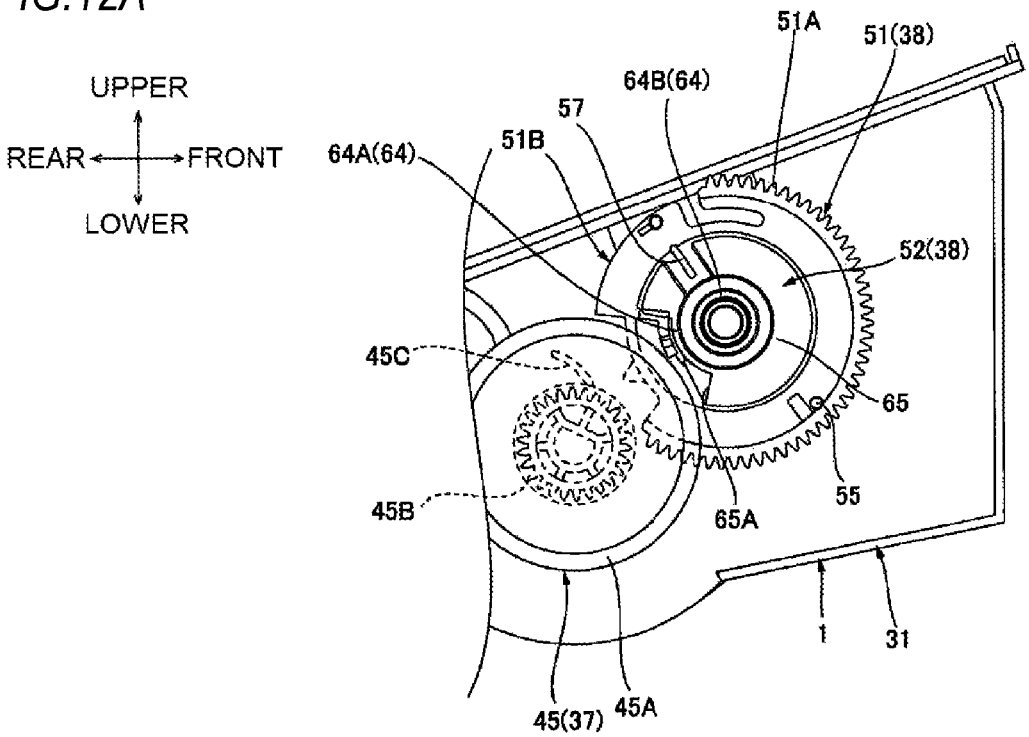
FIG. 12A illustrates the new product detection operation of the developing cartridge subsequent to FIG. 10C, illustrating a state where a engaged state between the teeth part of the toothless gear and the agitator gear is released.
Figure 12B:
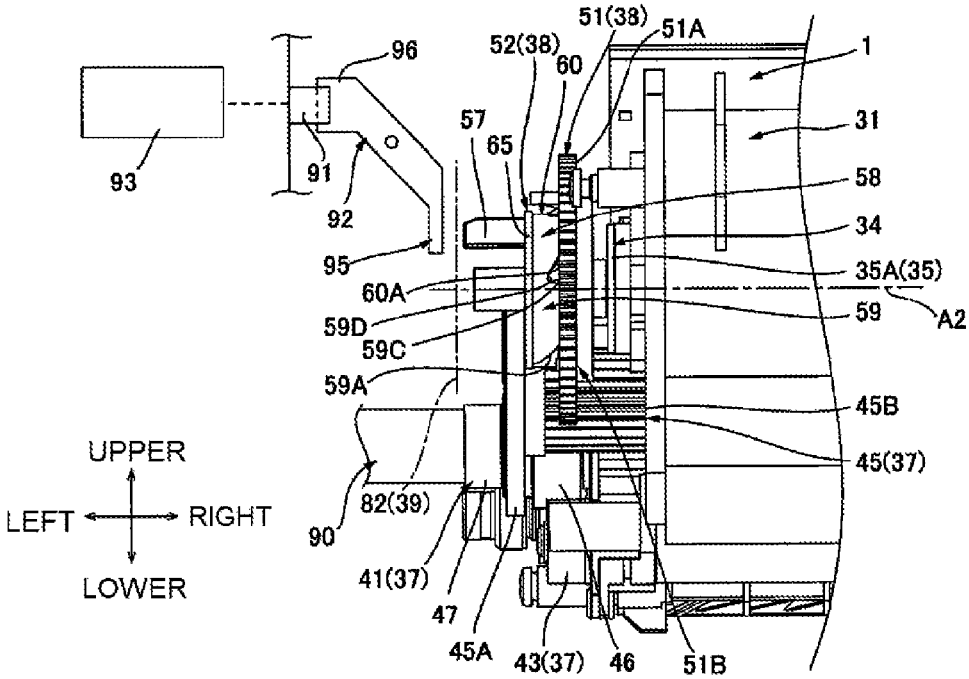
FIG. 12B is a front view of the developing cartridge shown in FIG. 12A, illustrating a state where the detection member is located at a retreat position and the actuator is located at the non-detection position.

Then, when the toothless gear 51 is further rotated, the toothless gear 51 is stopped as the teeth part 51A of the toothless gear 51 separates from the second gear part 45B of the agitator gear 45, as shown in FIG. 12A. At this time, as shown in FIG. 12B, the first detection member 52A is located at the retreat position. Thereby, the third time reciprocating movement of the first detection member 52A is completed.

When the light receiving signal is received three times after the warm-up operation starts, the control unit 93 determines that the developing cartridge 1 of which the maximum number of image formation sheets is 6,000 sheets has been mounted to the apparatus main body 12.

In the meantime, in case that the process cartridge 13 having the developing cartridge 1 of which the maximum number of image formation sheets is 3,000 sheets has been mounted to the apparatus main body 12, when the toothless gear 51 is rotated, the slide part 54 first abuts on the first displacement part 66 of the second detection member 52B (see FIGS. 5A and 5B). Then, the slide part 54 slides along the first inclined surface 66A and abuts on the first parallel surface 66B, so that the second detection member 52B is located at the standby position. Then, the slide part 54 slides along the second inclined surface 66C and abuts on the second parallel surface 66D, so that the second detection member 52B is located at the advance position. Thereafter, the slide part 54 slides along the third inclined surface 66E and abuts on the third parallel surface 66F, so that the second detection member 52B is located at the standby position. Thereby, the first reciprocating movement of the second detection member 52B is completed. Also, the optical sensor 91 outputs a first light receiving signal and then stops the output of the first light receiving signal.

Then, when the toothless gear 51 is further rotated, the slide part 54 abuts on the second displacement part 67 of the second detection member 52B. Then, like the above case where the slide part 54 abuts on the third displacement part 61 of the first detection member 52A, the second detection member 52B is located at the advance position and is then located at the retreat position. Thereby, the second time reciprocating movement of the second detection member 52B is completed. Also, the optical sensor 91 outputs a second time light receiving signal and then stops the output of the second time light receiving signal.

When the light receiving signal is received two times after the warm-up operation starts, the control unit 93 determines that the developing cartridge 1 of which the maximum number of image formation sheets is 3,000 sheets has been mounted to the apparatus main body 12.

Thereafter, when the predetermined time elapses, the control unit 93 ends the warm-up operation.

On the other hand, when the light receiving signal is not received from the optical sensor 91 within the predetermined time after the warm-up operation starts, the control unit 93 determines that the developing cartridge 1 used or being used is mounted to the apparatus main body 12.

6. Operational Effects (i) According to the developing cartridge 1, the detection member 52 is advanced leftward and is thus enabled to abut on the actuator 92, as shown in FIG. 10A, and is then retreated rightward, as shown in FIGS. 10B and 12B.

Also, it is possible to enable the detection member 52 to abut on the actuator 92 a plurality of times by reciprocally moving the detection member 52 in the left-right direction a plurality of times (specifically, two times or three times).

As a result, the apparatus main body 12 is enabled to recognize that the unused (new product) developing cartridge 1 has been mounted, and the control unit 93 of the apparatus main body 12 can reset the counted number of rotations of the developing roller 2.

(ii) According to the developing cartridge 1, as shown in FIG. 1, in the configuration where the developing roller 2 is provided, it is possible to recognize that the unused (new product) developing cartridge 1 has been mounted.

(iii) According to the developing cartridge 1, as shown in FIGS. 8B, 10A and 10B, the detection member 52 is moved only in the left-right direction while being restrained from rotating.

For this reason, as compared to a configuration where the detection member 52 is rotated, it is possible to save a space in a moving trajectory of the detection member 52.

(iv) According to the developing cartridge 1, as shown in FIGS. 8B, 10A and 10B, the driving force from the slide part 54 of the toothless gear 51 is applied to the detection member 52 at the displacement part 58.

For this reason, it is possible to transmit the driving force from the toothless gear 51 to the detection member 52 with a simple configuration.

(v) According to the developing cartridge 1, as shown in FIGS. 8B and 10A, as the toothless gear 51 is rotated, the slide part 54 of the toothless gear 51 gradually presses leftward the first inclined surface 59A of the first displacement part 59 of the detection member 52.

Thereby, it is possible to smoothly move leftward the detection member 52.

(vi) According to the developing cartridge 1, as shown in FIGS. 8B and 10A, the first inclined surface 59A of the first displacement part 59 and the first inclined surface 60A of the second displacement part 60 are arranged to be next to each other in the rotating direction R.

For this reason, it is possible to smoothly move the detection member 52 a plurality of times by the first inclined surface 59A of the first displacement part 59 and the first inclined surface 60A of the second displacement part 60.

(vii) According to the developing cartridge 1, as shown in FIGS. 8B and 10A, the first advancing operation of the detection member 52 is made due to the slide part 54 of the toothless gear 51 abutting on the first inclined surface 59A of the first displacement part 59 of the detection member 52. As shown in FIGS. 10B and 10C, the second time advancing operation of the detection member 52 is made due to the slide part 54 of the toothless gear 51 abutting on the first inclined surface 60A of the second displacement part 60 of the detection member 52.

Here, since the upstream end portion E1 of the first inclined surface 60A of the second displacement part 60 in the rotating direction is positioned closer to the developing frame 31 than the upstream end portion E2 of the first inclined surface 59A of the first displacement part 59 in the rotating direction, it is possible to start the second time advancing operation at the more rightward standby position than the first advancing operation.

Likewise, since the upstream end portion E3 of the first inclined surface 61A of the third displacement part 61 in the rotating direction is arranged at the same position in the left-right direction as the upstream end portion E1 of the first inclined surface 60A of the second displacement part 60 in the rotating direction, it is possible to start the third time advancing operation from the standby position.

For this reason, it is possible to shorten the movement distance of the detection member 52 during the second time and thereafter advancing operations.

Therefore, it is possible to keep inclined angles of the first inclined surface 60A of the second displacement part 60 and the first inclined surface 61A of the third displacement part 61 gentle.

As a result, it is possible to more smoothly move the detection member 52 a plurality of times.

(viii) According to the developing cartridge 1, it is possible to operate the developing cartridge 1 with the toothless gear 51 being stopped after the driving force is input from the apparatus main body 12 to the developing coupling 41 and until the abutting rib 45C of the agitator gear 45 abuts on the boss 55 of the toothless gear 51, as shown in FIG. 9A.

Thereafter, the abutting rib 45C of the agitator gear 45 abuts on the boss 55 of the toothless gear 51, so that it is possible to transmit the driving force from the agitator gear 45 to the toothless gear 51.

Thereby, after the developing cartridge 1 operates stably, the driving force is transmitted from the agitator gear 45 to the toothless gear 51. And then, the detection member 52 moves.

As a result, it is possible to enable the apparatus main body 12 to detect the detection member 52 while the developing cartridge 1 is stably operating.

(ix) According to the developing cartridge 1, as shown in FIG. 9A, the front end portion of the agitator gear 45 is positioned within the notched portion 65A of the detection member 52.

For this reason, it is possible to closely arrange the detection member 52 and the agitator gear 45 in the front-rear direction.

As a result, it is possible to make the developing cartridge 1 small.

(x) According to the developing cartridge 1, as shown in FIGS. 8B, 10A and 10B, the detection member 52 is advanced from the retreat position (see FIG. 8B) to the advance position (see FIG. 10A) and is then retreated to the standby position (see FIG. 10B) between the retreat position and the advance position during the first reciprocating movement. Then, during the second time reciprocating movement and thereafter, the detection member 52 is advanced from the standby position (see FIG. 10B) to the advance position (see FIG. 10A), as shown in FIGS. 10B and 10C.

For this reason, it is possible to start the second time and thereafter advancing operations from the more rightward standby position than the retreat position, so that it is possible to shorten the movement distance of the detection member 52, as compared to the movement distance of the first advancing operation.

Therefore, it is possible to keep the inclined angles of the first inclined surface 60A of the second displacement part 60 and the first inclined surface 61A of the third displacement part 61 gentle.

As a result, it is possible to reciprocally move the detection member 52 more smoothly.

(xi) According to the developing cartridge 1, as shown in FIG. 8B, when the developing cartridge 1 is not in use and the detection member 52 is not detected by the configuration of the apparatus main body 12, the detection member 52 is covered with the left wall 82A of the detection member accommodation part 82 of the gear cover 39, so that it is possible to reliably prevent an interference with a surrounding member.

(xii) According to the developing cartridge 1, as shown in FIGS. 8B and 12B, it is possible to reliably retreat rightward the detection member 52 by the urging force of the compression spring 63.

As a result, it is possible to suppress the interference between the detection member 52 and the surrounding member with the simple configuration.

(xiii) According to the developing cartridge 1, as shown in FIG. 8B, the gear cover 39 has the support shaft 73 supporting the detection member 52, and the toner cap 34 has the support shaft 36 supporting the toothless gear 51.

For this reason, it is possible to support the toothless gear 51 and the detection member 52 by using the gear cover 39 and the toner cap 34 while reducing the number of components.

Also, it is possible to rotate the rotary member at the position close to the developing frame 31 by supporting the toothless gear 51 to the support shaft 36 of the toner cap 34.

Thereby, it is possible to stably rotate the toothless gear 51.

Further, the detection member 52 is supported by the support shaft 73 of the gear cover 39 at the left of the developing frame 31.

For this reason, it is possible to stably advance leftward the detection member 52.

As a result, it is possible to stably advance leftward the detection member 52 by the driving force from the toothless gear 51 being stably rotated.

7. Second Illustrative Embodiment

A second illustrative embodiment of the developing cartridge is described with reference to FIGS. 13 to 18C. Meanwhile, in the second illustrative embodiment, the same members as the first illustrative embodiment are denoted with the same reference numerals and the descriptions thereof are omitted.

(i) Outline of Second Illustrative Embodiment

In the first illustrative embodiment, the toothless gear 51 consists of one member.

Figure 13:
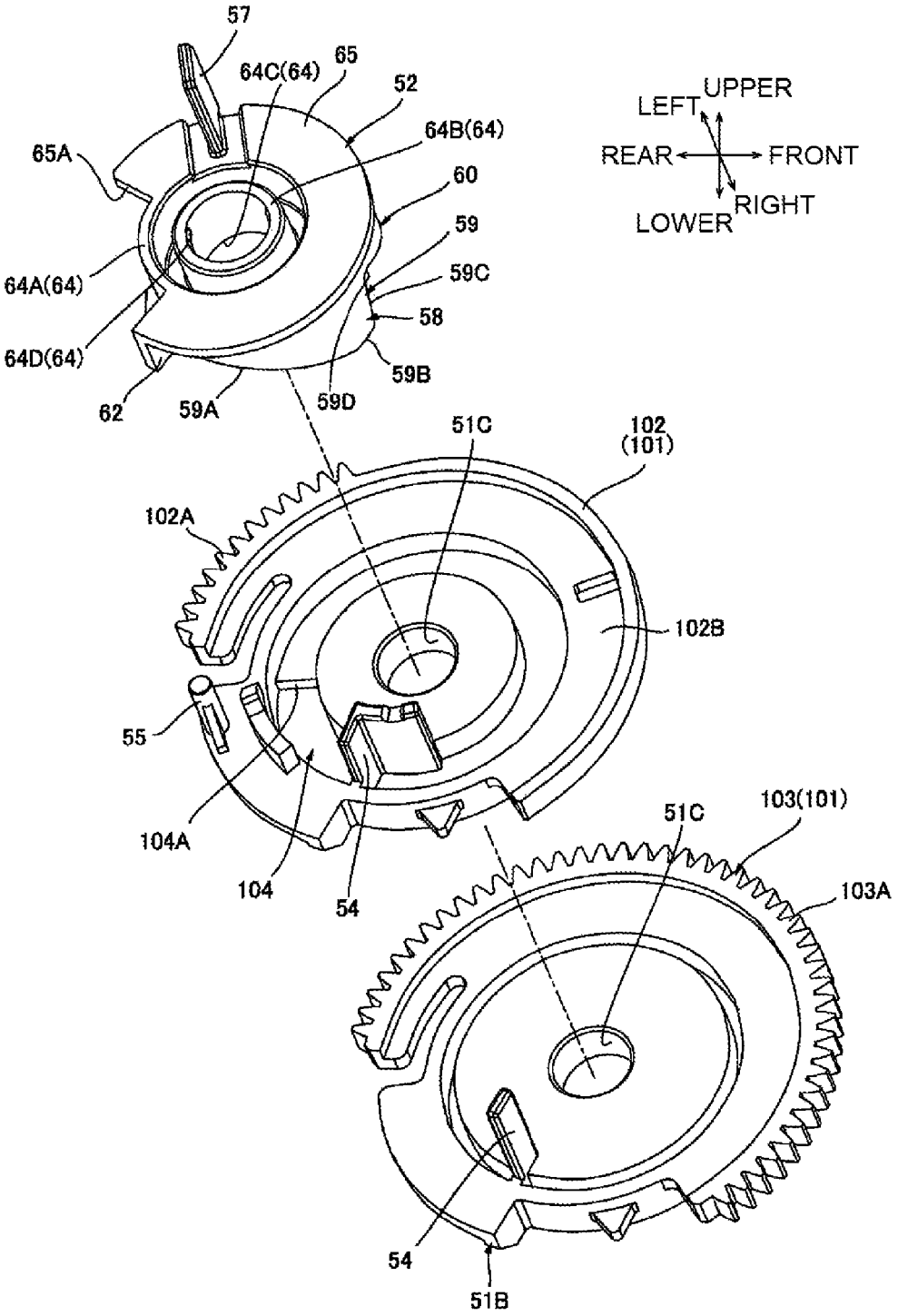
FIG. 13 is an exploded perspective view of a detection unit according to a second illustrative embodiment of the disclosure.
Figure 14A:
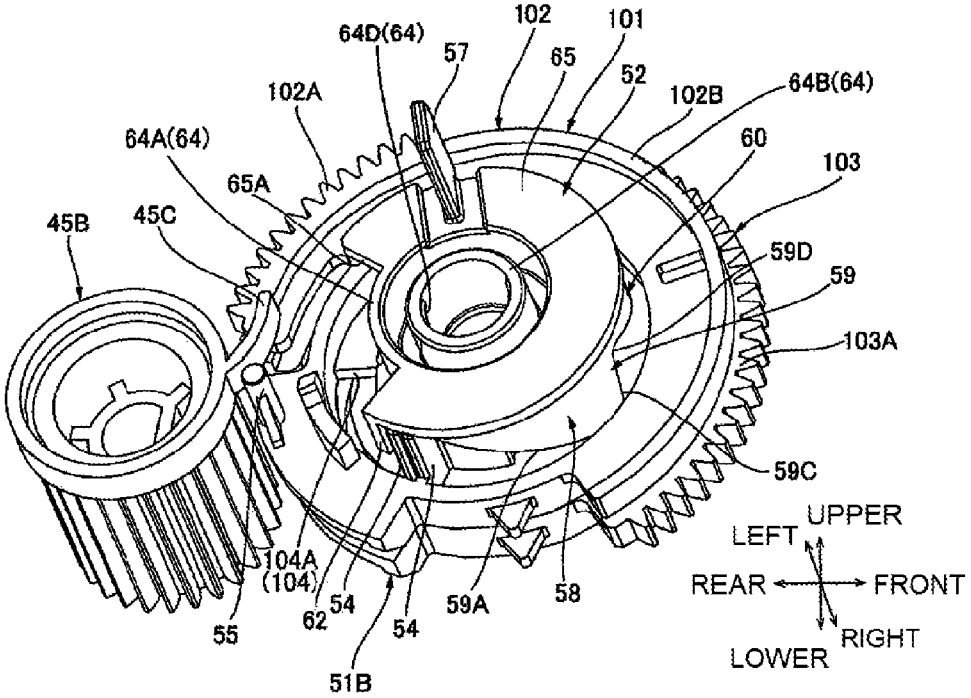
FIG. 14A illustrates a new product detection operation of the developing cartridge according to the second illustrative embodiment, illustrating a state where the abutting rib of the agitator gear abuts on a boss of a first toothless gear.

In contrast, in the second illustrative embodiment, as shown in FIGS. 13 and 14A, a toothless gear 101 is configured by a combination of two members of a first toothless gear 102 and a second toothless gear 103.

(ii) Configuration of Second Illustrative Embodiment

As shown in FIG. 13, the toothless gear 101 has the first toothless gear 102, which is an example of the first rotary member, and the second toothless gear 103, which is an example of the second rotary member.

The first toothless gear 102 has substantially the same shape as the toothless gear 51 of the first illustrative embodiment, except that ratios of a teeth part 102A and a toothless 102B in the circumferential direction are different and an opening 104 is formed.

The teeth part 102A is a part occupying about one-sixth (⅙) of the first toothless gear 102 in a circumferential direction, and corresponds to a fan-shaped part having a central angle of about 60° of the first toothless gear 102, in a side view.

The toothless part 102B is a part occupying about five-sixths (⅚) of the first toothless gear 102 in the circumferential direction, except for the teeth part 102A, and corresponds to a fan-shaped part having a central angle of about 300° of the first toothless gear 102, in a side view.

The opening 104 is arranged to be adjacent to an upstream side of the slide part 54 in the counterclockwise direction, as seen from the left side. The opening 104 has a substantially rectangular shape extending in the circumferential direction of the toothless 102B, in a side view.

The second toothless gear 103 has substantially the same shape as the toothless gear 51 of the first illustrative embodiment, except that it does not have the boss 55.

Figure 14B:
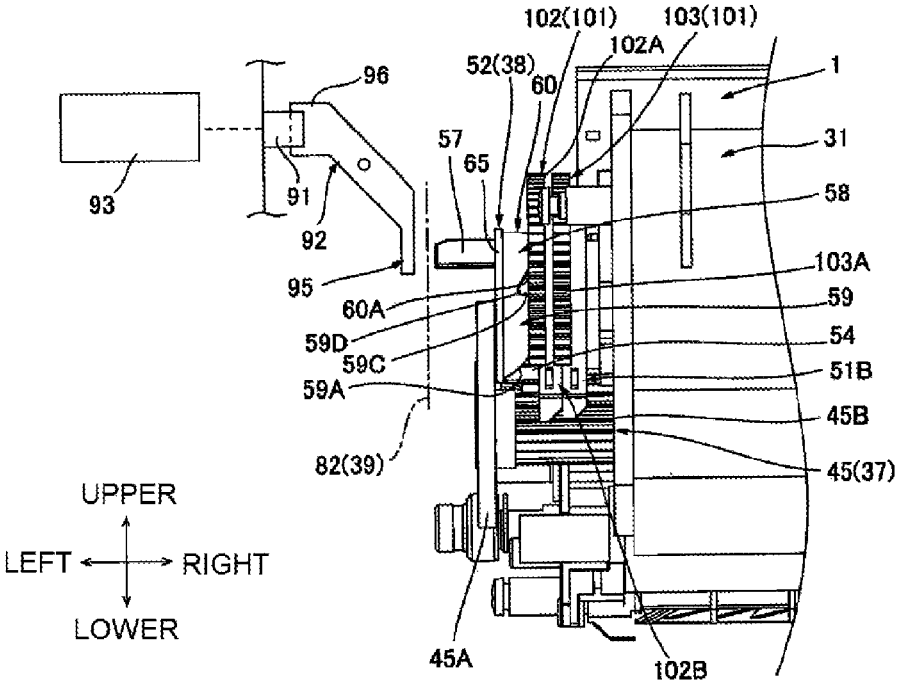
FIG. 14B is a front view of the developing cartridge shown in FIG. 14A, illustrating a state where the detection member is located at the retreat position and the actuator is located at the non-detection position.

As shown in FIGS. 14A and 14B, the first toothless gear 102 and the second toothless gear 103 are rotatably supported by the support shaft 36 of the toner cap 34 so that the first toothless gear 102 overlaps at the left of the second toothless gear 103.

The slide part 54 of the second toothless gear 103 is fitted in a downstream end portion of the opening 104 of the first toothless gear 102 in the counterclockwise direction, as seen from the left side. The slide part 54 of the second toothless gear 103 protrudes leftward through the opening 104 of the first toothless gear 102 and is arranged to overlap with an upstream side of the slide part 54 of the first toothless gear 102 in the counterclockwise direction, as seen from the left side.

(iii) Detection Operation of Second Illustrative Embodiment

At a state where the developing cartridge 1 is not used yet, i.e., the developing cartridge 1 is a new product, the slide part 54 of the second toothless gear 102 is arranged in front of the first inclined surface 59A of the detection member 52, as shown in FIG. 14B. Also, the detection member 52 is located at the retreat position.

When the warm-up operation of the image forming apparatus 11 starts and the agitator gear 45 is thus rotated, the abutting rib 45C is moved in accordance with the rotation of the agitator gear 45, abuts on the boss 55 of the first toothless gear 102 and presses the boss 55 in the front-lower direction, as shown in FIG. 14A.

Figure 15A:
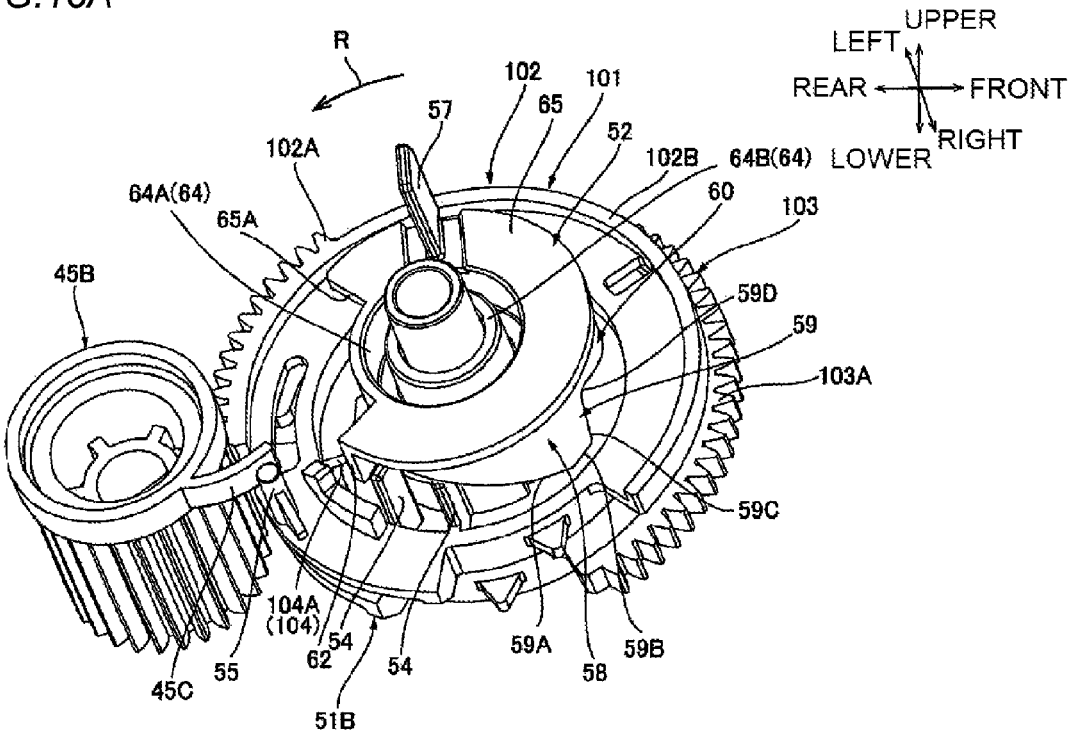
FIG. 15A illustrates the new product detection operation of the developing cartridge of the second illustrative embodiment subsequent to FIG. 14A, illustrating a state where the teeth part of the first toothless gear is engaged with the agitator gear.

Thereby, the first toothless gear 102 is rotated in the counterclockwise direction, as seen from the left side, and is engaged with the front upper end portion of the second gear part 45B of the agitator gear 45 at the gear teeth of the downstream end portion of the teeth part 102A in the counterclockwise direction, as seen from the left side, as shown in FIG. 15A.

Then, the driving force is transmitted from the agitator gear 45 to the first toothless gear 102, so that the first toothless gear 102 is rotated in the rotating direction R (counterclockwise direction, as seen from the left side).

Also, the slide part 54 of the first toothless gear 102 abuts on the first displacement part 59 of the detection member 52 from an upstream side in the rotating direction R.

Then, when the first toothless gear 102 is further rotated, the slide part 54 of the first toothless gear 102 presses leftward the first inclined surface 54A of the detection member 52 with sliding along the first inclined surface 54A in the rotating direction R. Thereby, the detection member 52 is gradually moved leftward against the urging force of the compression spring 63.

Then, the detection projection 57 is advanced more leftward than the gear cover 39 through the slit 71 and abuts on the pressed part 95 of the actuator 92 from right, thereby pressing leftward the pressed part 95. Thereby, the actuator 92 swings from the non-detection position in the counterclockwise direction, as seen from the front.

Figure 15B:
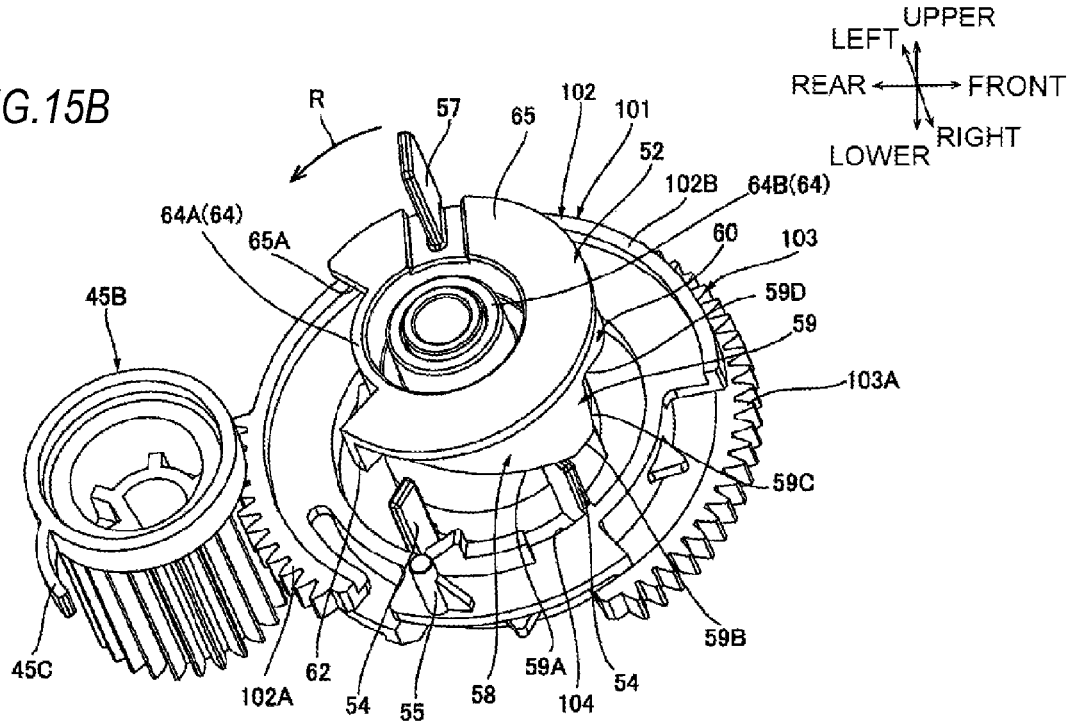
FIG. 15B illustrates the new product detection operation of the developing cartridge of the second illustrative embodiment subsequent to FIG. 15A, illustrating a state where a peripheral edge part of an opening of the first toothless gear abuts on the slide part of a second toothless gear.

When the first toothless gear 102 is further rotated, an edge portion 104A of an upstream end portion of the opening 104 in the rotating direction R abuts on the slide part 54 of the second toothless gear 103 just before the slide part 54 of the first toothless gear 102 abuts on the first parallel surface 59B of the first displacement part 59, as shown in FIG. 15B.

Thus, the edge portion 104A of the upstream end portion of the opening 104 in the rotating direction R presses the slide part 54 of the second toothless gear 103 in the rotating direction R in accordance with the rotation of the first toothless gear 102. Thereby, the second toothless gear 103 is rotated in the rotating direction R.

Figure 16A:
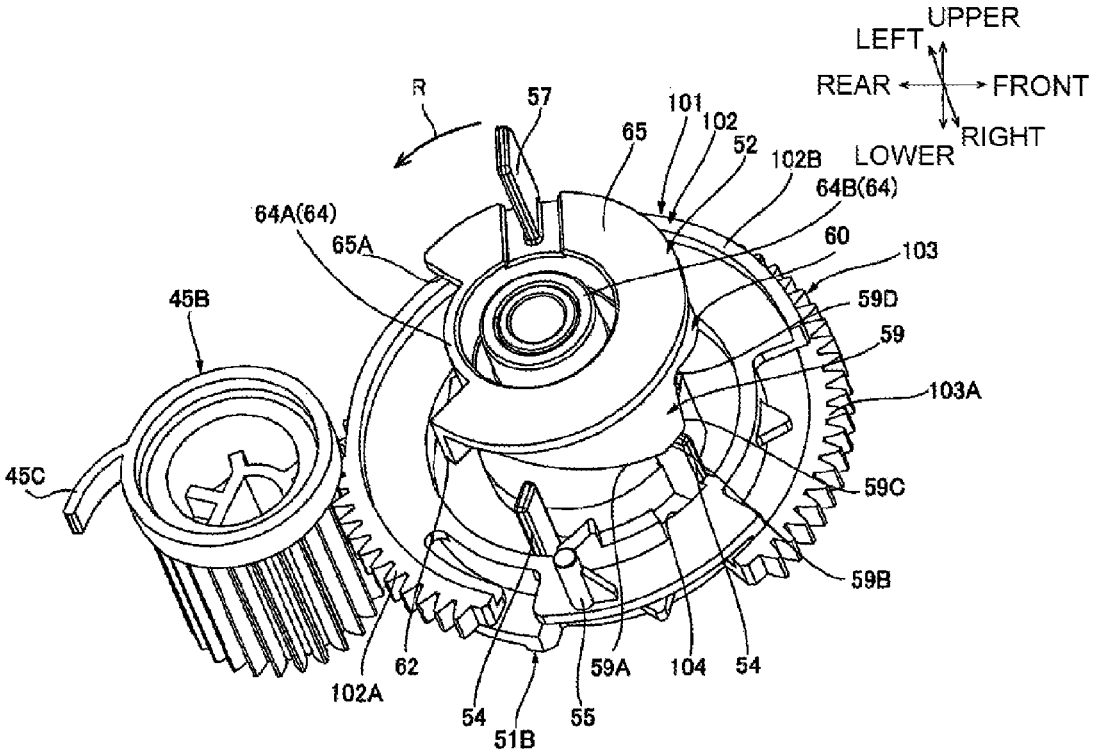
FIG. 16A illustrates the new product detection operation of the developing cartridge of the second illustrative embodiment subsequent to FIG. 15B, illustrating a state where the slide part of the first toothless gear abuts on the first parallel surface of the first displacement part of the detection member.
Figure 16B:
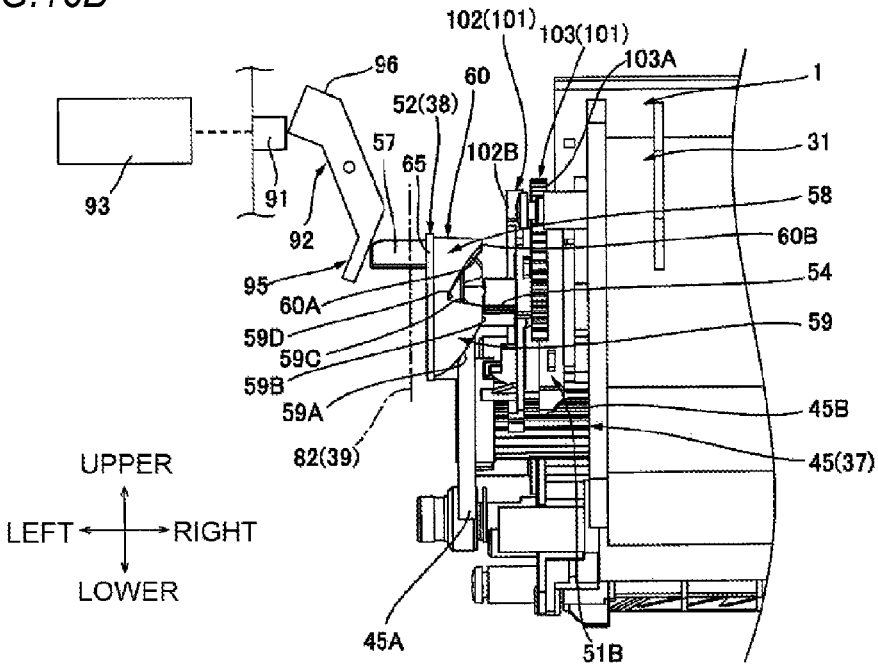
FIG. 16B is a front view of the developing cartridge shown in FIG. 16A, illustrating a state where the detection member is located at the advance position and the actuator is located at the detection position.

Then, when the first toothless gear 102 is further rotated, the detection member 52 is located at the advance position at the time that the slide part 54 of the first toothless gear 102 abuts on the first parallel surface 59B of the first displacement part 59, as shown in FIGS. 16A and 16B.

At this time, the actuator 92 is located at the detection position, and the optical sensor 91 outputs a first light receiving signal.

Then, when the first toothless gear 102 is further rotated, the slide part 54 of the first toothless gear 102 abuts on the second inclined surface 59C of the first displacement part 59 and slides along the second inclined surface 59C in the rotating direction R. Then, the detection member 52 is gradually moved leftward by the urging force of the compression spring 63.

Thereby, the detection projection 57 is gradually retreated into the gear cover 39 and is spaced leftward from the pressed part 95 of the actuator 92. Then, the actuator 92 swings from the detection position in the counterclockwise direction, as seen from the front, and is located at the non-detection position. Then, the optical sensor 91 stops the output of the first light receiving signal.

Figure 17A:
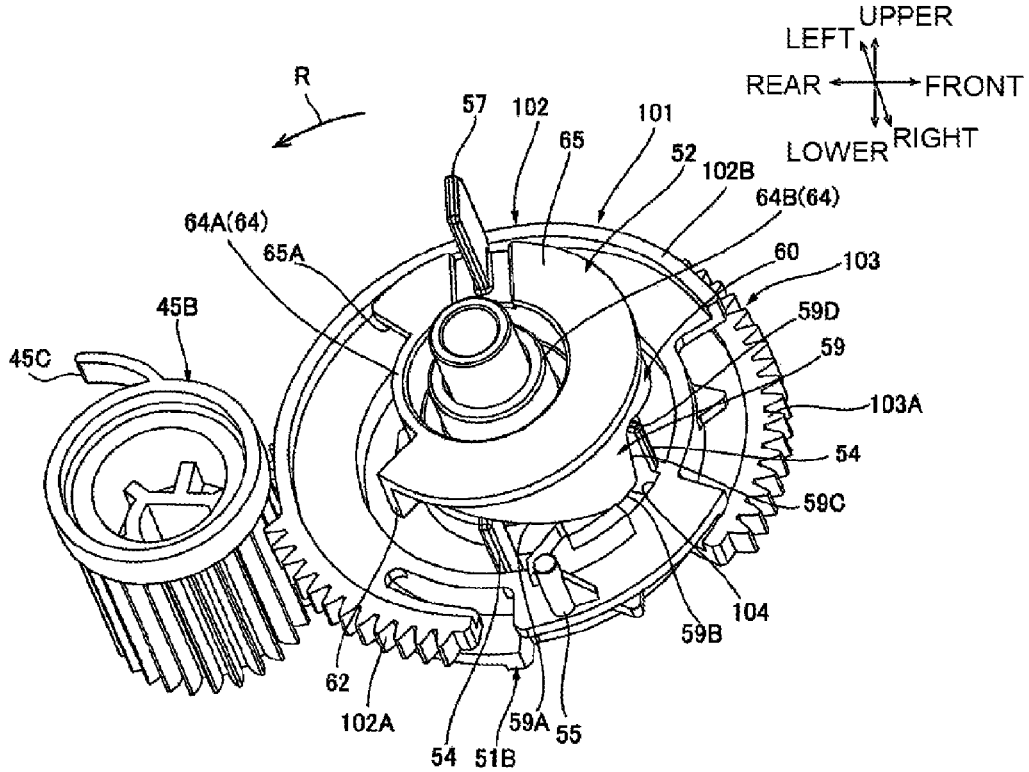
FIG. 17A illustrates the new product detection operation of the developing cartridge of the second illustrative embodiment subsequent to FIG. 16B, illustrating a state where the engaged state between the teeth part of the first toothless gear and the agitator gear is released and the slide part of the first toothless gear abuts on the second parallel surface of the first displacement part of the detection member.
Figure 17B:
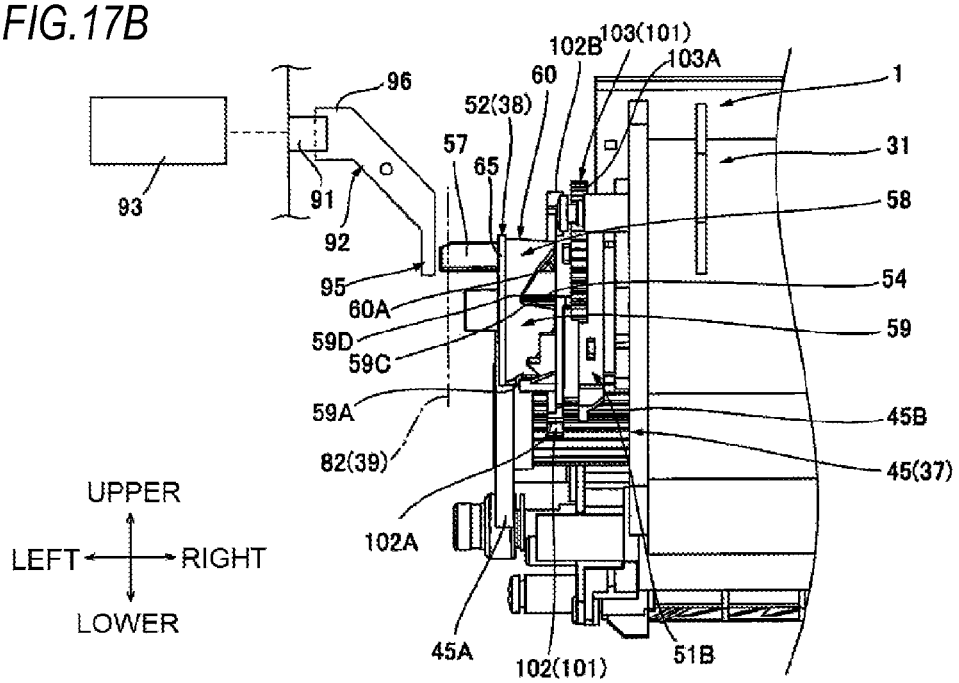
FIG. 17B is a front view of the developing cartridge shown in FIG. 17A, illustrating a state where the detection member is located at a standby position and the actuator is located at the non-detection position.

Then, when the first toothless gear 102 is further rotated, the slide part 54 of the first toothless gear 102 abuts on the second parallel surface 59D of the first displacement part 59 and the detection member 52 is located at the standby position, as shown in FIGS. 17A and 17B. Thereby, the first reciprocating movement of the first detection member 52A is completed.

At this time, the second toothless gear 103 is engaged with the front upper end portion of the second gear part 45B of the agitator gear 45 at the gear teeth of the downstream end portion of the teeth part 103A in the counterclockwise direction, as seen from the left side.

Then, the driving force is transmitted from the agitator gear 45 to the second toothless gear 103, so that the second toothless gear 103 is rotated in the rotating direction R.

Figure 18A:
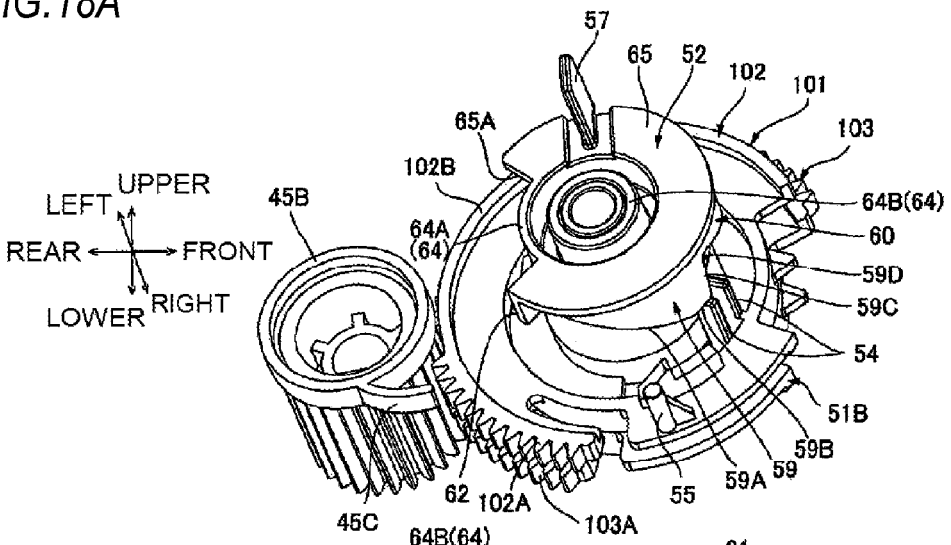
FIG. 18A illustrates the new product detection operation of the developing cartridge of the second illustrative embodiment subsequent to FIG. 17A, illustrating a state where the slide part of the second toothless gear abuts on the first parallel surface of the first displacement part of the detection member.

Then, when the second toothless gear 103 is further rotated, the slide part 54 of the second toothless gear 103 presses leftward the first displacement part 59, as shown in FIG. 18A.

Thus, the detection member 52 is located at the advance position, and the actuator 92 is located at the detection position. Thereby the optical sensor 91 outputs a second time light receiving signal.

Then, when the second toothless gear 103 is further rotated, the slide part 54 of the second toothless gear 103 abuts on the slide part 54 of the first toothless gear 102 and slides along the second inclined surface 59C of the first displacement part 59 with pressing the slide part 54 of the first toothless gear 102 in the rotating direction R. At this time, the slide part 54 of the second toothless gear 103 presses the slide part 54 of the first toothless gear 102, so that the second toothless gear 103 and the first toothless gear 102 are together rotated.

Thus, the detection member 52 is moved to the standby position, and the actuator 92 is located at the non-detection position. Thereby, the optical sensor 91 stops the output of the second time light receiving signal.

Figure 18B:
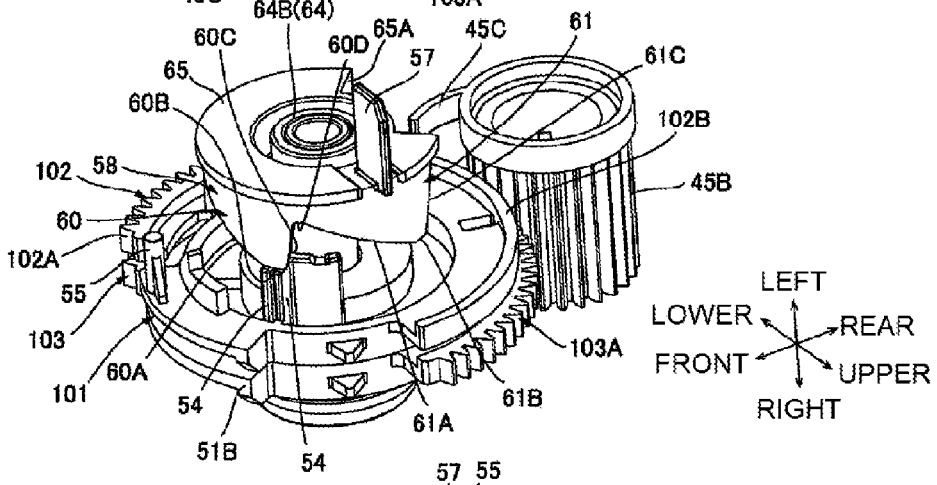
FIG. 18B illustrates the new product detection operation of the developing cartridge of the second illustrative embodiment subsequent to FIG. 18A, illustrating a state where the slide part of the first toothless gear and the slide part of the second toothless gear abut on the first parallel surface of the second displacement part of the detection member.

Then, when the second toothless gear 103 is further rotated, the slide part 54 of the first toothless gear 102 and the slide part 54 of the second toothless gear 103 abut on the second placement part 60, and the detection member 52 is located at the advance position and is then located at the standby position, as shown in FIG. 18B. Thereby, the actuator 92 is located at the detection position and is then located at the non-detection position, and the optical sensor 91 outputs a third time light receiving signal and then stops the output of the third time light receiving signal.

Then, when the second toothless gear 103 is further rotated, the slide part 54 of the first toothless gear 102 and the slide part 54 of the second toothless gear 103 abut on the third placement part 61, and the detection member 52 is located at the advance position and is then located at the retreat position. Thereby, the actuator 92 is located at the detection position and is then located at the non-detection position, and the optical sensor 91 outputs a fourth time light receiving signal and then stops the output of the fourth time light receiving signal.

Figure 18C:
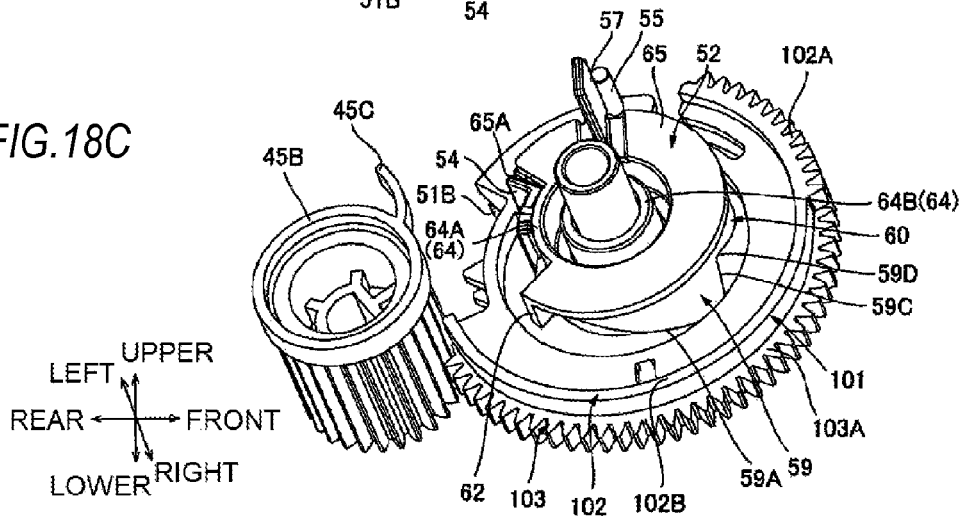
FIG. 18C illustrates the new product detection operation of the developing cartridge of the second illustrative embodiment subsequent to FIG. 18B, illustrating a state where the engaged state between the teeth part of the second toothless gear and the agitator gear is released.

Then, when the second toothless gear 103 is further rotated, the second toothless gear 103 is disengaged from the second gear part 45B of the agitator gear 45 and is thus stopped, as shown in FIG. 18C. At the same time, the first toothless gear 102, which is being rotated together, is also stopped.

Thereafter, when the predetermined time elapses, the control unit 93 ends the warm-up operation.

(iv) Operational Effects of the Second Illustrative Embodiment (iv-1) According to the developing cartridge 1 of the second illustrative embodiment, after the first toothless gear 102 is rotated, as shown in FIGS. 15B and 16A, the second toothless gear 103 is rotated, as shown in FIGS. 17A and 18A. Then, the detection member 52 receives the driving force through the slide part 54 of the first toothless gear 102 and the slide part 54 of the second toothless gear 103.

For this reason, as compared to a configuration where the detection member of one toothless gear is moved, it is possible to increase a driving amount of the toothless gear 101 in accordance with a sum of respective driving amounts of the first toothless gear 102 and second toothless gear 103.

Thereby, it is possible to further increase the number of reciprocation times (specifically, four times) of the detection member 52 and to further secure a degree of freedom of a detection pattern.

As a result, it is possible to enable the apparatus main body 12 to recognize the more information.

(iv-2) Also in the second illustrative embodiment, it is possible to accomplish the same operational effects as the first illustrative embodiment.

8. Modified Embodiments (i) First Modified Embodiment

Figure 19A:
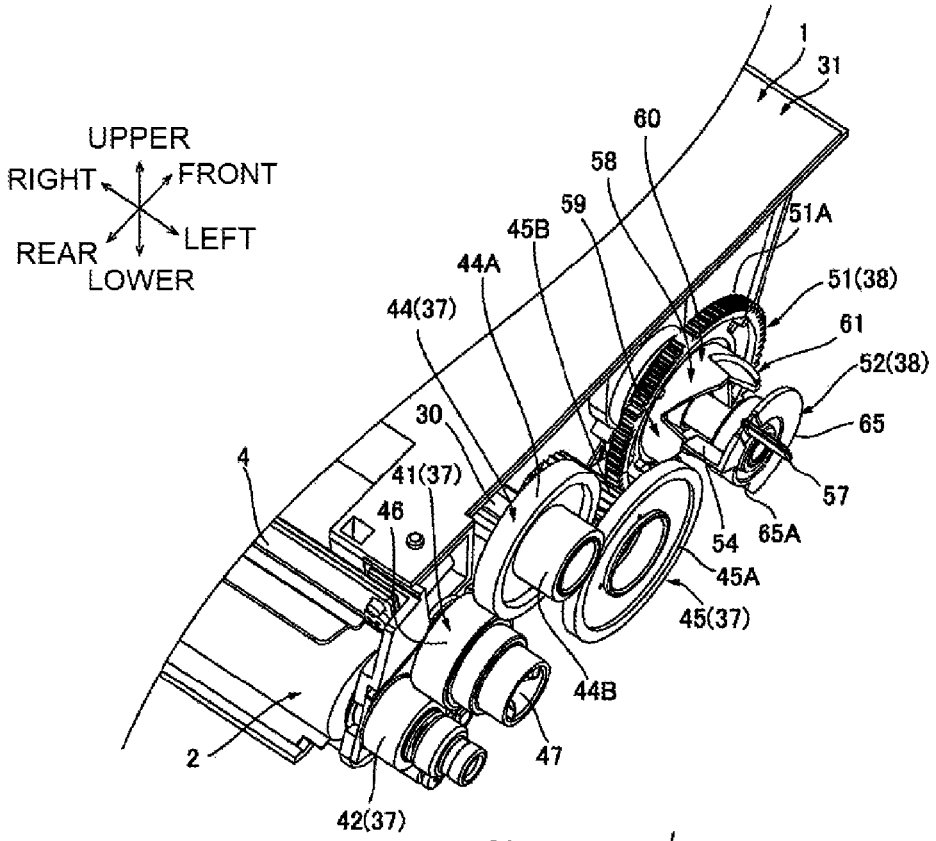
FIG. 19A illustrates a first modified embodiment of the developing cartridge.

In the first illustrative embodiment, the displacement part 58 is provided to the detection member 52, and the slide part 54 is provided to the toothless gear 51. However, as shown in FIG. 19A, the displacement part 58 may be provided to the toothless gear 51, and the slide part 54 may be provided to the detection member 52.

In this case, the downstream end portion of the first displacement part 59 in the counterclockwise direction, as seen from the left side, is arranged at the right of the second placement part 60 and the third displacement part 61 in the counterclockwise direction, as seen from the left side.

Also in the first modified embodiment, it is possible to accomplish the same operational effects as the first illustrative embodiment.

(ii) Second Modified Embodiment

Figure 19B:
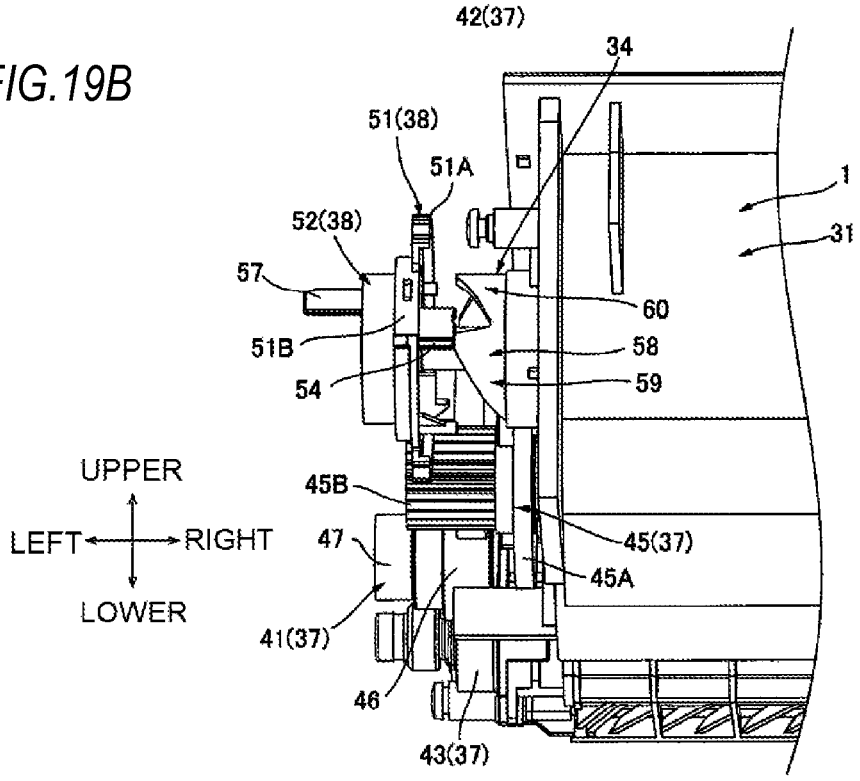
FIG. 19B illustrates a second modified embodiment of the developing cartridge.

Also, as shown in FIG. 19B, the displacement part 58 may be provided to the toner cap 34, and the slide part 54 may be provided to the toothless gear 51.

Also, in this case, the displacement part 58 may be provided to the developing frame 31.

Also in the second modified embodiment, it is possible to accomplish the same operational effects as the first illustrative embodiment.

(iii) Third Modified Embodiment

Figure 20A:
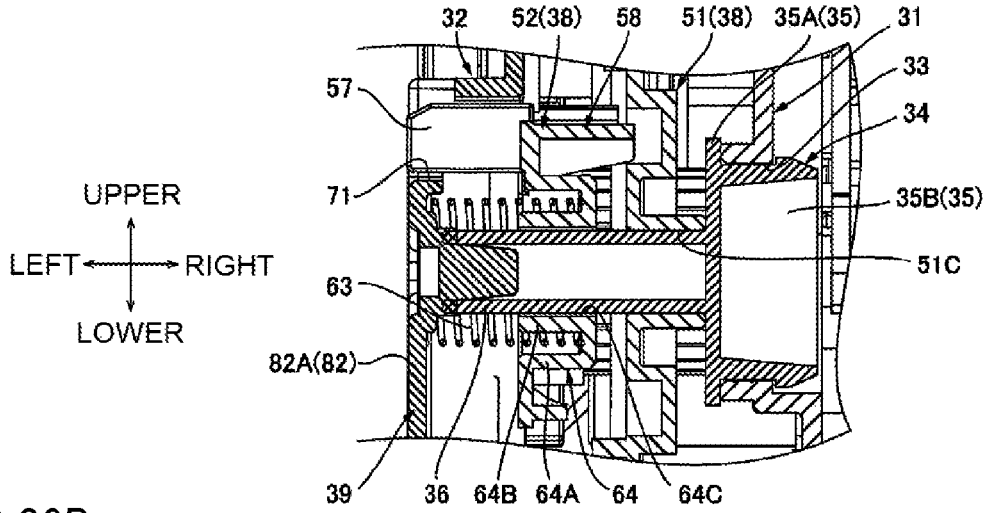
FIG. 20A illustrates a third modified embodiment of the developing cartridge.

In the first illustrative embodiment, the support 36 of the toner cap 34 supports the toothless gear 51, and the support shaft 73 of the gear cover 39 supports the detection member 52. However, as shown in FIG. 20A, the gear cover 39 may not be provided with the support shaft 73 and the support shaft 36 of the toner cap 34 may be elongated in the left-right direction to support the toothless gear 51 and the detection member 52 to the support shaft 36 of the toner cap 34.

Also in the third modified embodiment, it is possible to accomplish the same operational effects as the first illustrative embodiment.

(iv) Fourth Modified Embodiment

Figure 20B:
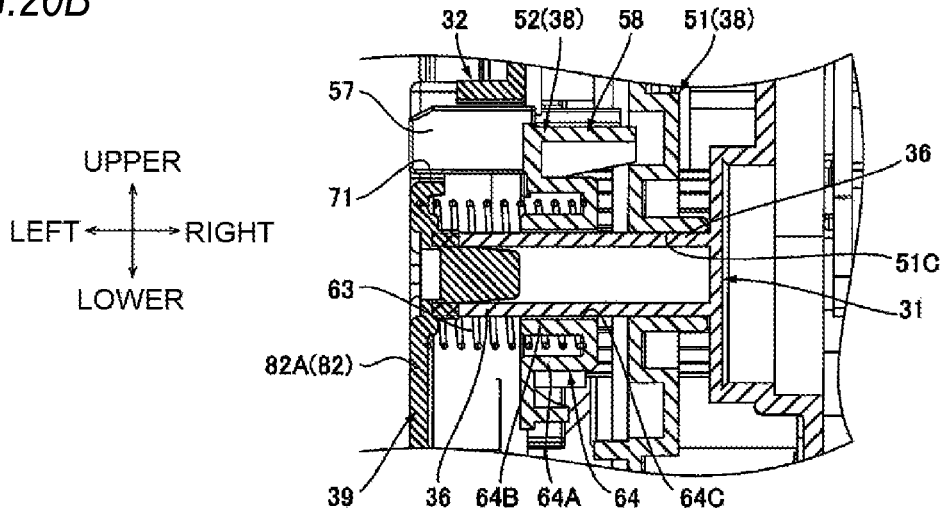
FIG. 20B illustrates a fourth modified embodiment of the developing cartridge.

In the third illustrative embodiment, the toner cap 34 is provided with the support shaft 36. However, the support shaft 36 may be provided on the left wall of the developing frame 31, as shown in FIG. 20B.

Also in the fourth modified embodiment, it is possible to accomplish the same operational effects as the first illustrative embodiment.

(v) Fifth Modified Embodiment

Figure 20C:
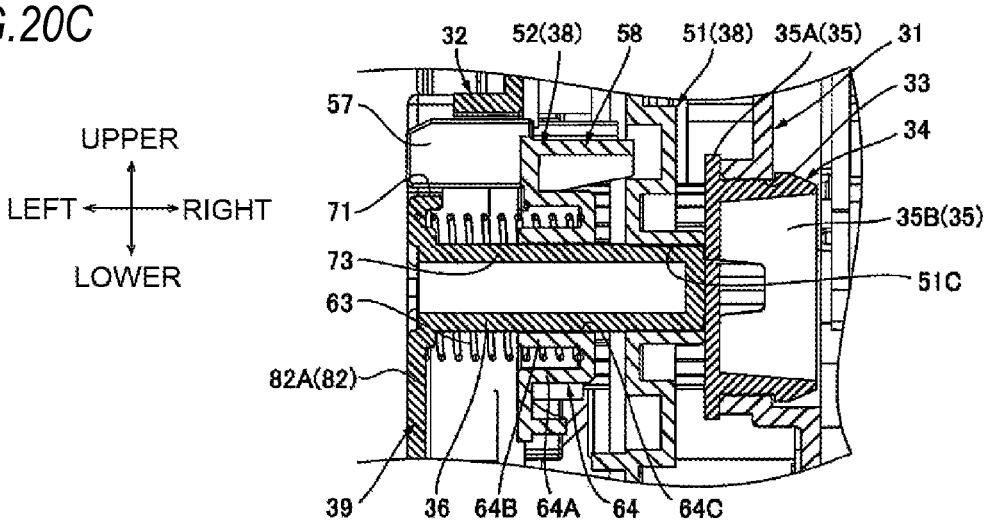
FIG. 20C illustrates a fifth modified embodiment of the developing cartridge.

Also, as shown in FIG. 20C, the toner cap 34 may not be provided with the support shaft 36 and the gear cover 39 may be configured with the support shaft 73 elongated in the left-right direction to support the toothless gear 51 and the detection member 52 to the support shaft 73 of the gear cover 39.

Also, in this case, the support shaft 73 provided to the gear cover 39 may be supported by the developing frame 31, instead of the toner cap 34.

Also in the fifth modified embodiment, it is possible to accomplish the same operational effects as the first illustrative embodiment.

(vi) Sixth Modified Embodiment

In the first illustrative embodiment, the toothless gear 51 has been exemplified as the rotary member, and the agitator gear 45 has been exemplified as the transmission member. However, the rotary member and the transmission member are not limited to the gear.

For example, the rotary member and the transmission member may be configured by friction wheels having no gear teeth.

Figure 21:
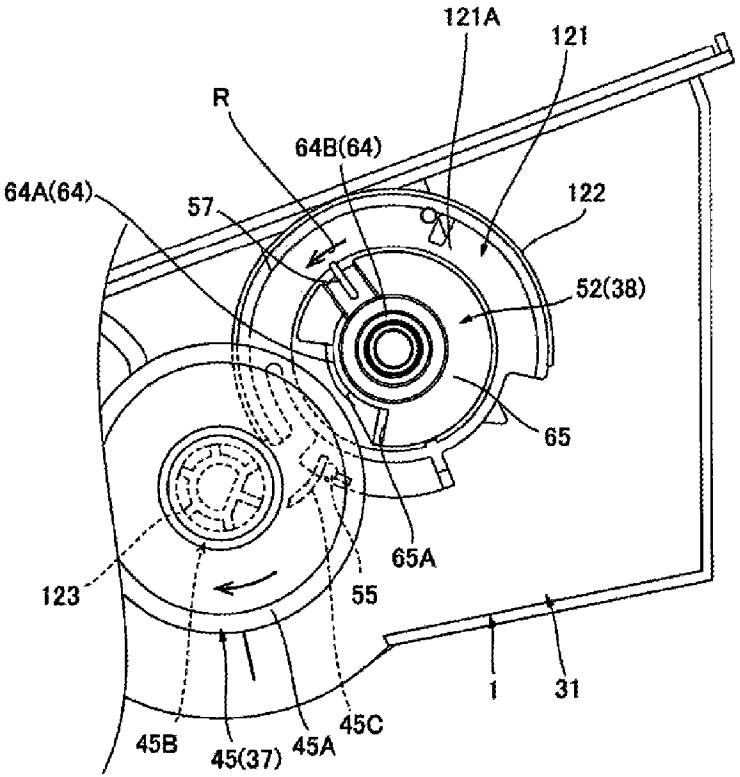
FIG. 21 illustrates a sixth modified embodiment of the developing cartridge.
Figure 21:
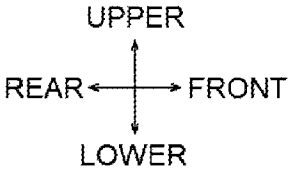

Specifically, as shown in FIG. 21, the second gear part 45B of the agitator gear 45 may be provided with a first resistance applying member 123 of which at least an outer peripheral surface is configured by a material having a relatively large friction coefficient such as rubber, instead of the gear teeth, a transmitted part 121A of a rotary member 121 may be provided with a second resistance applying member 122 of which at least an outer peripheral surface is configured by a material having a relatively large friction coefficient such as rubber, instead of the gear teeth, and the driving force may be transmitted through friction between the resistance applying members.

Also, in this case, the second gear part 45B of the agitator gear 45 may be configured to have the gear teeth and only the transmitted part 121A of the rotary member 121 may be provided with the second resistance applying member 122 of which the outer peripheral surface is configured by the material having a relatively large friction coefficient such as rubber.

Also in the sixth modified embodiment, it is possible to accomplish the same operational effects as the first illustrative embodiment.

(vii) Seventh Modified Embodiment

Figure 22A:
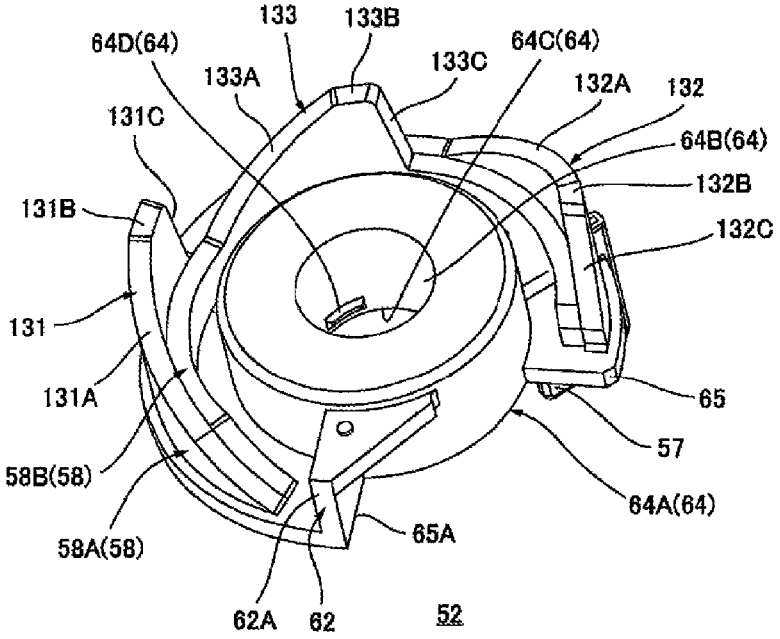
FIG. 22A is a perspective view of a seventh modified embodiment of the developing cartridge, as seen from a right-lower side.
Figure 22B:
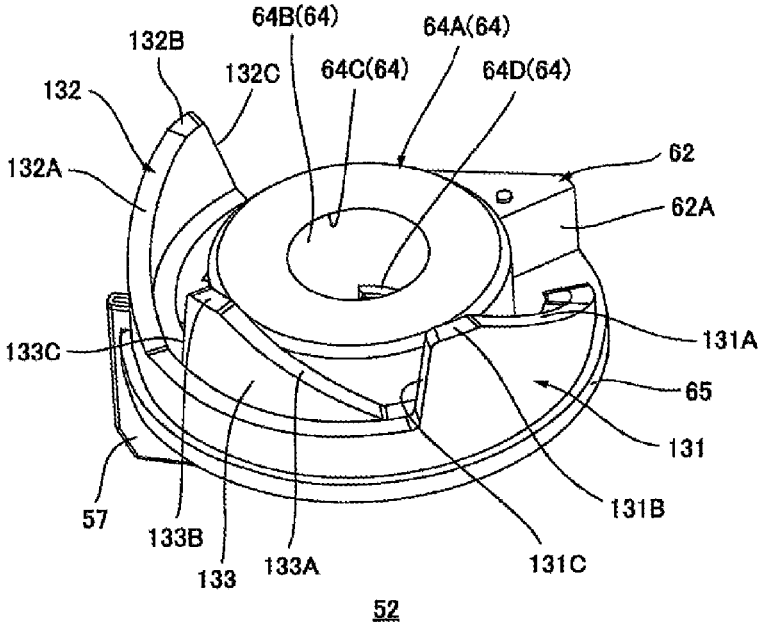
FIG. 22B is a perspective view of the seventh modified embodiment of the developing cartridge, as seen from a right-front side

In the first illustrative embodiment, the one displacement part 58 of the first detection member 52A is provided with the first displacement part 59, the second placement part 60 and the third displacement part 61. However, for example, like a third detection member 52C shown in FIGS. 22A and 22B, two displacement parts 58 may be arranged to overlap with each other in the diametrical direction of the detection member 52 and a diametrically outer-side displacement part 58A and a diametrically inner-side displacement part 58B may be provided with any one of a first displacement part 131, a second displacement part 133 and a third displacement part 132, respectively. That is, the first displacement part 131, the second displacement part 133 and the third displacement part 132 may be arranged to deviate each other in the diametrical direction of the detection member 52.

Specifically, the diametrically outer-side displacement part 58A may be provided with the first displacement part 131 and the third displacement part 132, and the diametrically inner-side displacement part 58B may be provided with the second displacement part 133.

Also in the seventh modified embodiment, it is possible to accomplish the same operational effects as the first illustrative embodiment.

(viii) Other Modified Embodiments

In the first illustrative embodiment, the developing coupling 41 has been exemplified as the driving receiving part. However, the driving receiving part is not limited to the shaft coupling such as the developing coupling 41 and may be a gear, for example.

Also, in the first illustrative embodiment, the developing cartridge 1 having the developing roller 2 has been exemplified as the cartridge. However, the cartridge may be configured by a toner cartridge having only the toner accommodating portion 5, without the developing roller 2 and the supply roller 3, for example.

Also, in the first illustrative embodiment, the developing roller 2 has been exemplified as the developer carrier. However, for example, a developing sleeve and the like may also be applied as the developer carrier.

Also, in the first illustrative embodiment, the agitator gear 45 supported by the rotary shaft of the agitator 6 has been exemplified as the transmission member. However, the transmission member may be configured by an idle gear, which is not coupled to the rotary shaft of the agitator 6 and is supported by the left wall of the developing frame 31.

Also, in the first illustrative embodiment, the compression spring 63 has been exemplified as the urging member. However, a shape of the urging member is not limited to the coil shape, and a plate spring and the like may also be applied, for example.

Also, in the first illustrative embodiment, the detection member is once moved from the retreat position to the standby position and is then reciprocally moved between the standby position and the advance position. That is, the movement distance of the detection member 52 during the second time and thereafter advancing operations is shorter than the movement distance of the detection member 52 during the first advancing operation.

However, the movement distances of the detection member 52 during the respective advancing operations may be the same or may be all different.

Also, during one advancing and retreating operation, the movement distance of the detection member 52 during the advancing operation and the movement distance of the detection member 52 during the retreating operation may be the same or different.

Also, in the first illustrative embodiment, the detection projection 57 is completely accommodated in the gear cover 39 when the detection member 52 is located at the retreat position. However, the detection projection 57 may slightly protrude from the gear cover 39 when the detection member 52 is located at the retreat position.

Also, in the first illustrative embodiment, both sidewalls of the developing frame 31 in the left-right direction extend in the front-rear direction, respectively. However, at least one of both sidewalls of the developing frame 31 in the left-right direction may be inclined relative to the front-rear direction.

Also, in the first illustrative embodiment, the first detection member 52A is mounted to the developing cartridge 1 of which the maximum number of image formation sheets is 6,000 sheets, and the second detection member 52B is mounted to the developing cartridge 1 of which the maximum number of image formation sheets is 3,000 sheets. However, the relation between the detection member 52 and the maximum number of image formation sheets is not particularly limited and may be appropriately set inasmuch as the specification of the developing cartridge 1 can be distinguished.

For example, the first detection member 52A may be mounted to the developing cartridge 1 of which the maximum number of image formation sheets is 3,000 sheets, and the second detection member 52B may be mounted to the developing cartridge 1 of which the maximum number of image formation sheets is 6,000 sheets.

Also, the numerical values of the maximum number of image formation sheets are not limited to the above numerical values and may be appropriately set. For example, the first detection member 52A may be mounted to the developing cartridge 1 of which the maximum number of image formation sheets is 1,000 sheets, and the second detection member 52B may be mounted to the developing cartridge 1 of which the maximum number of image formation sheets is 2,000 sheets.

Also, in the first illustrative embodiment, the idle gear support shaft 30 is integrally provided to the developing frame 31. However, the idle gear support shaft 30 may be configured as a separate member from the developing frame 31.

Also, in the first illustrative embodiment, the support shaft (not shown) supporting the developing coupling 41 is integrally provided to the developing frame 31. However, the support shaft (not shown) supporting the developing coupling 41 may be configured as a separate member from the developing frame 31.

Also, in the first illustrative embodiment, the control unit 93 counts the number of rotations of the developing roller 2. However, for example, the control unit 93 may count the number of rotations of the agitator 6 or to measure a remaining amount of toner in the toner accommodating portion 5. In this case, the control unit 93 resets the number of rotations of the agitator 6 or the measured value of the remaining amount of toner in the toner accommodating portion 5 when it is determined that an unused (new product) developing cartridge 1 has been mounted.

The above illustrative embodiments and modified embodiments may be combined with each other.

The disclosure provides illustrative, non-limiting aspects as follows:

According to an aspect of the disclosure, there is provided a cartridge including: a housing configured to accommodate therein developer; a driving receiving part configured to rotate by receiving a driving force; and a detected member configured to move in an axis direction parallel with a rotational axis of the driving receiving part by receiving a driving force from the driving receiving part, wherein the detected member is configured to perform a reciprocating movement, in which the detected member moves outward in the axis direction to be away from the housing and then moves inward in the axis direction to be closer to the housing, for a plurality of times.

According to the above configuration, it is possible to enable an external device to detect the detected member a plurality of times by reciprocally moving the detected member in the axis direction a plurality of times.

As a result, it is possible to enable an external device to recognize that an unused cartridge has been mounted.

According to another aspect of the disclosure, there is provided a cartridge including: a housing configured to accommodate therein developer; a driving receiving part configured to rotate by receiving a driving force, and a detected member configured to move in an axis direction parallel with a rotational axis of the driving receiving part by receiving a driving force from the driving receiving part, wherein the detected member is configured to perform: a first movement, in which the detected member moves outward in the axis direction to be away from the housing and then moves inward in the axis direction to be closer to the housing; and a second movement, which is performed after the first movement and in which the detected member moves outward in the axis direction to be away from the housing and then moves inward in the axis direction to be closer to the housing.

According to the above configuration, it is possible to enable the external device to detect the detected member a plurality of times by reciprocally moving the detected member a plurality of times in the axis direction, including the first reciprocating movement and the second reciprocating movement.

As a result, it is possible to enable the external device to recognize that an unused cartridge has been mounted.

The above cartridges may further include a developer carrier configured to carry thereon developer.

According to the above configuration, in the configuration where the developer carrier is provided, it is possible to protect the detected part and to enable the external device to recognize that an unused cartridge has been mounted.

In the above cartridges, the detected member may be configured to move in the axis direction while being restrained from rotating.

According to the above configuration, it is possible to move the detected member only in the axis direction.

For this reason, as compared to a configuration where the detected member is rotated, it is possible to save a moving trajectory space of the detected member.

The above cartridges may further include a rotary member configured to rotate by receiving the driving force from the driving receiving part. The detected member may be configured to receive the driving force from the driving receiving part via the rotary member.

According to the above configuration, it is possible to transmit the driving force to the detected member with a simple configuration by the rotary member.

In the above cartridges, the rotary member may includes a first rotary member configured to rotate by receiving the driving force from the driving receiving part, and a second rotary member configured to rotate by receiving the driving force from the driving receiving part, after the first rotary member is rotated. The detected member may be configured to receive the driving force from the driving receiving part via the second rotary member after receiving the driving force from the driving receiving part via the first rotary member.

According to the above configuration, the first rotary member is rotated, and then, the second rotary member is rotated. The detected member receives the driving force through the first and second rotary members.

For this reason, as compared to a configuration where the detected part is moved by one rotary member, it is possible to increase a driving amount of the rotary member in accordance with a sum of respective driving amounts of the first and second rotary members.

Thereby, it is possible to further increase the number of reciprocation times of the detected member and to further secure a degree of freedom of a detection pattern.

As a result, it is possible to enable the external information to recognize more information.

In the above cartridges, the rotary member may include an operating part configured to apply a force for moving the detected member in the axis direction to the detected member. The detected member may include an abutment part configured to be abutted on by the operating part. At least one of the operating part and the abutment part may include an inclined part inclined in a direction from the detected member to the rotary member towards a downstream side in a rotating direction of the rotary member.

According to the above configuration, when the operating part of the rotary member has the inclined part, as the rotary member is rotated, the inclined part of the rotary member gradually presses the abutment part of the detected member in the axis direction.

Also, when the abutment part of the detected member has the inclined part, as the rotary member is rotated, the operating part of the rotary member gradually presses the inclined part of the detected member in the axis direction.

Thereby, it is possible to smoothly move the detected member in the axis direction by the inclined part provided to at least one of the operating part of the rotary member and the abutment part of the detected member.

In the above cartridges, the inclined part may include a first inclined part and a second inclined part arranged next to the first inclined part in the rotating direction.

According to the above configuration, it is possible to smoothly move the detected member a plurality of times by the first inclined part and the second inclined part.

In the above cartridges, the abutment part may include the inclined part. The first inclined part may be configured to initially abut on the operating part, and the second inclined part may be configured to abut on the operating part later than the first inclined part. An upstream end portion of the first inclined part in the rotating direction may be positioned closer to the housing than an upstream end portion of the second inclined part in the rotating direction.

According to the above configuration, the initial advancing operation of the detected member is made due to the operating part abutting on the first inclined part. Also, the advancing operation after the initial advancing operation is made due to the operating part abutting on the second inclined part.

Here, since an upstream end portion of the second inclined part in the rotating direction is more distant from the housing than an upstream end portion of the first inclined part in the rotating direction, it is possible to start the advancing operation after the initial advancing operation from a more outer side in the axis direction.

For this reason, it is possible to shorten a movement distance of the detected member during the advancing operation after the initial advancing operation.

Therefore, it is possible to gently keep an inclined angle of the second inclined part.

As a result, it is possible to more smoothly move the detected member a plurality of times.

In the above cartridges, the operating part may include the inclined part. The first inclined part may be configured to initially abut on the abutment part, and the second inclined part may be configured to abut on the abutment part later than the first inclined part. A downstream end portion of the first inclined part in the rotating direction may be positioned closer to the housing than a downstream end portion of the second inclined part in the rotating direction.

According to the above configuration, the initial advancing operation of the detected member is made due to the first inclined part abutting on the abutment part. Also, the advancing operation after the initial advancing operation is made due to the second inclined part abutting on the abutment part.

Here, since the upstream end portion of the second inclined part in the rotating direction is more distant from the housing than the upstream end portion of the first inclined part in the rotating direction, it is possible to start the advancing operation after the initial advancing operation from a more outer side in the axis direction.

For this reason, it is possible to shorten the movement distance of the detected member during the advancing operation after the initial advancing operation.

Therefore, it is possible to gently keep the inclined angle of the second inclined part.

As a result, it is possible to more smoothly move the detected member a plurality of times.

The above cartridges may further include a transmission member configured to rotate by receiving the driving force from the driving receiving part, and including a transmitting part configured to transmit the driving force to the rotary member and an engaging part provided at a position different from the transmitting part and configured to move in accordance with rotation of the transmission member. The rotary member may include a transmitted part configured to abut on the transmitting part and an engaged part configured to abut on the engaging part. The rotary member may be configured to move from a stop position at which an abutting state between the transmitted part and the transmitting part is released to a driving position at which the transmitted part thus abuts on the transmitting part due to the engaging part abutting on the engaged part.

According to the above configuration, it is possible to operate the cartridge with the rotary member being stopped after the driving force is input from the external device to the driving receiving part until the engaging part of the transmission member abuts on the engaged part of the rotary member.

Thereafter, the engaging part of the transmission member abuts on the engaged part of the rotary member, so that it is possible to transmit the driving force from the transmission member to the rotary member.

Thereby, after the cartridge operates stably, the driving force is transmitted from the transmission member to the rotary member, thereby moving the detected member.

As a result, it is possible to enable the external device to detect the detected part while the cartridge is stably operating.

In the above cartridges, the detected member may include a notched portion notched in a direction away from the transmission member. At least a portion of the transmission member may be positioned within the notched portion.

According to the above configuration, it is possible to closely arrange the detected member and the transmission member so that at least a part of the transmission member is located in the notched portion.

As a result, it is possible to make the cartridge small.

In the above cartridges, the detected member may be configured to move from a first position to a third position via a second position during an initial reciprocating movement after the detected member receives the driving force from the driving receiving part, the second position being more distant from the housing than the first position, and the third position being located between the first position and the second position. The detected member may be configured to move from the third position to the first position or the third position via the second position during the reciprocating movement after the initial reciprocating movement.

In the above cartridges, the detected member may be configured to move from a first position to a third position via a second position during an initial movement after the detected member receives the driving force from the driving receiving part, the second position being more distant from the housing than the first position, and the third position being located between the first position and the second position. The detected member may be configured to move from the third position to the first position or the third position via the second position during the movement after the initial movement.

According to the above configuration, during the initial reciprocating movement of the detected member, the detected member is advanced from the first position to the second position and is then retreated to the third position between the first position and the second position. During the reciprocating movement after the initial reciprocating movement, the detected member is advanced from the third position to the first position.

For this reason, during the later reciprocating movement, it is possible to start the advancing operation from a more outer side in the axis direction, so that it is possible to shorten the movement distance of the detected member.

As a result, it is possible to more smoothly reciprocate the detected member.

The above cartridges may further include a covering member including a covering part that faces the detected member from an opposite side of the housing in the axis direction.

According to the above configuration, when the detected part is not detected by the external device, it is possible to cover the detected member by the covering part, thereby reliably preventing an interference with the external device.

The above cartridges may further include an urging member abutting on the covering part and the detected member to urge the detected member towards the housing.

According to the above configuration, it is possible to reliably retreat the detected member in a direction from the covering part to the rotary member by the urging force of the urging member.

In the above cartridge, at least one of the covering member and the housing may include a support part that supports the detected member.

According to the above configuration, it is possible to reduce the number of components and to support the detected member by using at least one of the covering member and the housing.

The above cartridges may further include a rotary member configured to rotate by receiving the driving force from the driving receiving part. The support part may include a first support part provided to the covering member and a second support part provided to the housing. The detected member may be supported by the first support part. The rotary member may be supported by the second support part.

According to the above configuration, the rotary member is supported by the second support part of the housing, so that it is possible to rotate the rotary member at a position close to the housing.

Thereby, it is possible to stably rotate the rotary member.

Further, the detected member is supported by the first support part of the covering member at an outer side than the housing in the axis direction.

For this reason, it is possible to stably move the detected member towards the outer side in the axis direction.

As a result, it is possible to stably move the detected member towards the outer side in the axis direction by the driving force from the rotary member being stably rotated.

In the above cartridges, the housing may include a filling port for filling the developer inside the housing, and a closing member that closes the filling port. The support part may be provided to the closing member.

According to the above configuration, it is possible to support the detected member by using the closing member that closes the filling port while reducing the number of components.

According to the cartridge of the disclosure, it is possible to enable the external device to recognize that the unused cartridge has been mounted.

What is claimed is:

1. A cartridge comprising:

a housing configured to accommodate therein developer;

a driving receiving part configured to rotate by receiving a driving force;

a detected member configured to move in an axis direction parallel with a rotational axis of the driving receiving part by receiving a driving force from the driving receiving part; and a rotary member configured to rotate by receiving the driving force from the driving receiving part, wherein the detected member is configured to perform a reciprocating movement, in which the detected member moves outward in the axis direction to be away from the housing and then moves inward in the axis direction to be closer to the housing, for a plurality of times, wherein the detected member is configured to receive the driving force from the driving receiving part via the rotary member, wherein the rotary member includes an operating part configured to apply a force for moving the detected member in the axis direction to the detected member, wherein the detected member includes an abutment part configured to be abutted on by the operating part, and wherein at least one of the operating part and the abutment part includes an inclined part inclined in a direction from the detected member to the rotary member towards a downstream side in a rotating direction of the rotating member.

2. The cartridge according to claim 1, further comprising:

a developer carrier configured to carry thereon developer.

3. The cartridge according to claim 1, wherein the detected member is configured to move in the axis direction while being restrained from rotating.

4. The cartridge according to claim 1, wherein the rotary member includes:

a first rotary member configured to rotate by receiving the driving force from the driving receiving part, and a second rotary member configured to rotate by receiving the driving force from the driving receiving part, after the first rotary member is rotated, and wherein the detected member is configured to receive the driving force from the driving receiving part via the second rotary member after receiving the driving force from the driving receiving part via the first rotary member.

5. The cartridge according to claim 1, wherein the inclined part includes a first inclined part and a second inclined part arranged next to the first inclined part in the rotating direction.

6. The cartridge according to claim 5, wherein the abutment part includes the inclined part, wherein the first inclined part is configured to initially abut on the operating part, and the second inclined part is configured to abut on the operating part later than the first inclined part, and wherein an upstream end portion of the first inclined part in the rotating direction is positioned closer to the housing than an upstream end portion of the second inclined part in the rotating direction.

7. The cartridge according to claim 5, wherein the operating part includes the inclined part, wherein the first inclined part is configured to initially abut on the abutment part, and the second inclined part is configured to abut on the abutment part later than the first inclined part, and wherein a downstream end portion of the first inclined part in the rotating direction is positioned closer to the housing than a downstream end portion of the second inclined part in the rotating direction.

8. The cartridge according to claim 1, further comprising:

a transmission member configured to rotate by receiving the driving force from the driving receiving part, and including a transmitting part configured to transmit the driving force to the rotary member and an engaging part provided at a position different from the transmitting part and configured to move in accordance with rotation of the transmission member, wherein the rotary member includes a transmitted part configured to abut on the transmitting part and an engaged part configured to abut on the engaging part, and wherein the rotary member is configured to move from a stop position at which an abutting state between the transmitted part and the transmitting part is released to a driving position at which the transmitted part thus abuts on the transmitting part due to the engaging part abutting on the engaged part.

9. The cartridge according to claim 8, wherein the detected member includes a notched portion notched in a direction away from the transmission member, and wherein at least a portion of the transmission member is positioned within the notched portion.

10. The cartridge according to claim 1, wherein the detected member is configured to move from a first position to a third position via a second position during an initial reciprocating movement after the detected member receives the driving force from the driving receiving part, the second position being more distant from the housing than the first position, and the third position being located between the first position and the second position, and wherein the detected member is configured to move from the third position to the first position or the third position via the second position during the reciprocating movement after the initial reciprocating movement.

11. The cartridge according to claim 1, further comprising:

a covering member including a covering part that faces the detected member from an opposite side of the housing in the axis direction.

12. The cartridge according to claim 11, further comprising:

an urging member abutting on the covering part and the detected member to urge the detected member towards the housing.

13. The cartridge according to claim 11, wherein at least one of the covering member and the housing includes a support part that supports the detected member.

14. The cartridge according to claim 13, further comprising:

a rotary member configured to rotate by receiving the driving force from the driving receiving part, wherein the support part includes a first support part provided to the covering member and a second support part provided to the housing, wherein the detected member is supported by the first support part, and wherein the rotary member is supported by the second support part.

15. The cartridge according to claim 13, wherein the housing includes a filling port for filling the developer inside the housing, and a closing member that closes the filling port, and wherein the support part is provided to the closing member.

16. A cartridge comprising:

a housing configured to accommodate therein developer;

a driving receiving part configured to rotate by receiving a driving for force;

a detected member configured to move in an axis direction parallel with a rotational axis of the driving receiving part by receiving a driving force from the driving receiving part; and a rotary member configured to rotate by receiving the driving force from the driving receiving part, wherein the detected member is configured to perform:

a first movement, in which the detected member moves outward in the axis direction to be away from the housing and then moves inward in the axis direction to be closer to the housing; and a second movement, which is performed after the first movement and in which the detected member moves outward in the axis direction to be away from the housing and then moves inward in the axis direction to be closer to the housing, wherein the detected member is configured to receive the driving force from the driving receiving part via the rotary member, wherein the rotary member includes an operating part configured to apply a force for moving the detected member in the axis direction to the detected member, wherein the detected member includes an abutment part configured to be abutted on by the operating part, and wherein at least one of the operating part and the abutment part includes an inclined part inclined in a direction from the detected member to the rotary member towards a downstream side in a rotating direction of the rotary member.

17. The cartridge according to claim 16, further comprising:

a developer carrier configured to carry thereon developer.

18. The cartridge according to claim 16, wherein the detected member is configured to move in the axis direction while being restrained from rotating.

19. The cartridge according to claim 16, wherein the rotary member includes:

a first rotary member configured to rotate by receiving the driving force from the driving receiving part, and a second rotary member configured to rotate by receiving the driving force from the driving receiving part, after the first rotary member is rotated, and wherein the detected member is configured to receive the driving force from the driving receiving part via the second rotary member after receiving the driving force from the driving receiving part via the first rotary member.

20. The cartridge according to claim 16, wherein the inclined part includes a first inclined part and a second inclined part arranged next to the first inclined part in the rotating direction.

21. The cartridge according to claim 20, wherein the abutment part includes the inclined part, wherein the first inclined part is configured to initially abut on the operating part, and the second inclined part is configured to abut on the operating part later than the first inclined part, and wherein an upstream end portion of the first inclined part in the rotating direction is positioned closer to the housing than an upstream end portion of the second inclined part in the rotating direction.

22. The cartridge according to claim 20, wherein the operating part includes the inclined part, wherein the first inclined part is configured to initially abut on the abutment part, and the second inclined part is configured to abut on the abutment part later than the first inclined part, and wherein a downstream end portion of the first inclined part in the rotating direction is positioned closer to the housing than a downstream end portion of the second inclined part in the rotating direction.

23. The cartridge according to claim 16, further comprising:

a transmission member configured to rotate by receiving the driving force from the driving receiving part, and including a transmitting part configured to transmit the driving force to the rotary member and an engaging part provided at a position different from the transmitting part and configured to move in accordance with rotation of the transmission member, wherein the rotary member includes a transmitted part configured to abut on the transmitting part and an engaged part configured to abut on the engaging part, and wherein the rotary member is configured to move from a stop position at which an abutting state between the transmitted part and the transmitting part is released to a driving position at which the transmitted part thus abuts on the transmitting part due to the engaging part abutting on the engaged part.

24. The cartridge according to claim 23, wherein the detected member includes a notched portion notched in a direction away from the transmission member, and wherein at least a portion of the transmission member is positioned within the notched portion.

25. The cartridge according to claim 16, wherein the detected member is configured to move from a first position to a third position via a second position during an initial movement after the detected member receives the driving force from the driving receiving part, the second position being more distant from the housing than the first position, and the third position being located between the first position and the second position, and wherein the detected member is configured to move from the third position to the first position or the third position via the second position during the movement after the initial movement.

26. The cartridge according to claim 16, further comprising:

a covering member including a covering part that faces the detected member from an opposite side of the housing in the axis direction.

27. The cartridge according to claim 26, further comprising:

an urging member abutting on the covering part and the detected member to urge the detected member towards the housing.

28. The cartridge according to claim 26, wherein at least one of the covering member and the housing includes a support part that supports the detected member.

29. The cartridge according to claim 28, further comprising:

a rotary member configured to rotate by receiving the driving force from the driving receiving part, wherein the support part includes a first support part provided to the covering member and a second support part provided to the housing, wherein the detected member is supported by the first support part, and wherein the rotary member is supported by the second support part.

30. The cartridge according to claim 28, wherein the housing includes a filling port for filling the developer inside the housing, and a closing member that closes the filling port, and wherein the support part is provided to the closing member.

31. A cartridge comprising:

a housing configured to accommodate therein developer;

a driving receiving part configured to rotate by receiving a driving force;

a detected member configured to move in an axis direction parallel with a rotational axis of the driving receiving part by receiving a driving force from the driving receiving part; and a rotary member configured to rotate by receiving the driving force from the driving receiving part, wherein the detected member is configured to perform a reciprocating movement, in which the detected member moves outward in the axis direction to be away from the housing and then moves inward in the axis direction to be closer to the housing, for a plurality of times;

wherein the detected member is configured to receive the driving force from the driving receiving part via the rotary member, wherein the rotary member includes:

a first rotary member configured to rotate by receiving the driving force from the driving receiving part, and a second rotary member configured to rotate by receiving the driving force from the driving receiving part, after the first rotary member is rotated, and wherein the detected member is configured to receive the driving force from the driving receiving part via the second rotary member after receiving the driving force from the driving receiving part via the first rotary member.

* * * * *